US008552864B2

(12) United States Patent
Aizawa et al.

(10) Patent No.: US 8,552,864 B2
(45) Date of Patent: Oct. 8, 2013

(54) INTRUSION DETECTION SYSTEM AND INTRUSION DETECTION APPARATUS

(75) Inventors: Naoki Aizawa, Chiyoda-ku (JP); Akihiro Toyohara, Chiyoda-ku (JP); Yoshio Sato, Chiyoda-ku (JP); Shuji Aizawa, Chiyoda-ku (JP); Sayu Takamatsu, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 163 days.

(21) Appl. No.: 13/312,244

(22) Filed: Dec. 6, 2011

(65) Prior Publication Data

US 2012/0319843 A1 Dec. 20, 2012

(30) Foreign Application Priority Data

Jun. 14, 2011 (JP) ..... 2011-132231

(51) Int. Cl.
*G08B 13/00* (2006.01)

(52) U.S. Cl.
USPC ..... 340/541; 340/552

(58) Field of Classification Search
USPC ..... 340/541, 552, 561, 565; 342/28, 342/90
See application file for complete search history.

(56) References Cited

U.S. PATENT DOCUMENTS

| | | | | |
|---|---|---|---|---|
| 7,675,416 | B2 * | 3/2010 | Sato | 340/552 |
| 7,760,088 | B2 * | 7/2010 | Tsuji | 340/552 |
| 8,390,449 | B2 * | 3/2013 | Toyohara et al. | 340/552 |

FOREIGN PATENT DOCUMENTS

| | | | |
|---|---|---|---|
| JP | 4-167717 | A | 6/1992 |
| JP | 2001-268021 | A | 9/2001 |
| JP | 2007-179402 | A | 7/2007 |

* cited by examiner

*Primary Examiner* — Toan N Pham
(74) *Attorney, Agent, or Firm* — Buchanan Ingersoll & Rooney PC

(57) ABSTRACT

For one setting operator being able to readily adjust a threshold by oneself, by means of reporting units that issue a report to indicate the amount of variation in a received electric wave when an intruding object has intruded between a transmitting leaking transmission path and a receiving leaking transmission path, and a remote controller that generates a signal which changes a threshold in the table through the receiving leaking transmission path, the threshold is adjusted properly for each of the blocks with the remote controller based on the report issued from the reporting unit to indicate the amount of variation in the received electric wave caused by a trial intrusion between the two transmission paths by a threshold setting operator.

19 Claims, 41 Drawing Sheets

(EXAMPLE OF AREA AND BLOCK IN BASIC CONFIGURATION)

(DESCRIPTION OF BASIC CONFIGURATION)

(EXAMPLE OF AREA AND BLOCK IN BASIC CONFIGURATION)

(FLOW OF REPORT IN BASIC CONFIGURATION)

FIG.4

(EXAMPLE OF THRESHOLD/BLOCK TABLE IN BASIC CONFIGURATION)

| AREA NUMBER | 1 | 2 | 3 | 4 | 5 | 6 | ... |
|---|---|---|---|---|---|---|---|
| BLOCK NUMBER | 1 | 1 | 1 | 2 | 2 | 3 | |
| THRESHOLD | 20 | 20 | 20 | 15 | 15 | 10 | |

(EXAMPLE OF THRESHOLD AND REPORT IN BASIC CONFIGURATION)

(THRESHOLD SETTING IN BASIC CONFIGURATION)

(FLOW OF THRESHOLD ADJUSTMENT PROCEDURE IN BASIC CONFIGURATION)

(FLOW OF BLOCK ADJUSTMENT PROCEDURE IN BASIC CONFIGURATION)

(DESCRIPTION OF EMBODIMENT 1)

(THRESHOLD SETTING IN EMBODIMENT 1)

(FLOW OF THRESHOLD ADJUSTMENT OF EMBODIMENT 1)

(DETAILED CONFIGURATION OF REMOTE CONTROL SIGNAL GENERATOR OF EMBODIMENT 1)

(TRANSMITTED REMOTE CONTROL SIGNAL WAVEFORM OF EMBODIMENT 1)

(RECEIVED REMOTE CONTROL SIGNAL WAVEFORM OF EMBODIMENT 1)

(FLOW OF THRESHOLD ADJUSTMENT INPUT OF EMBODIMENT 1)

(DETAILED CONFIGURATION OF REMOTE CONTROL INPUT DEVICE OF EMBODIMENT 1)

(FLOW OF BLOCK ADJUSTMENT OF EMBODIMENT 1)

(FLOW OF BLOCK ADJUSTMENT INPUT OF EMBODIMENT 1)

(DESCRIPTION OF EMBODIMENT 2) DEDICATED SIGNAL (DETAILED CONFIGURATION EXAMPLE 1 OF REMOTE CONTROL SIGNAL GENERATOR OF EMBODIMENT 2) DEDICATED SIGNAL (SIGNAL WAVEFORM OF DETAILED CONFIGURATION EXAMPLE 1 OF EMBODIMENT 2)
DEDICATED SIGNAL (DETAILED CONFIGURATION EXAMPLE 1 OF REMOTE CONTROL SIGNAL RECEIVER OF EMBODIMENT 2) DEDICATED SIGNAL (DETAILED CONFIGURATION EXAMPLE 2 OF REMOTE CONTROL SIGNAL GENERATOR OF EMBODIMENT 2) DEDICATED SIGNAL (SIGNAL WAVEFORM OF DETAILED CONFIGURATION EXAMPLE 2 OF EMBODIMENT 2)
DEDICATED SIGNAL (DETAILED CONFIGURATION EXAMPLE 2 OF REMOTE CONTROL SIGNAL RECEIVER OF EMBODIMENT 2) DEDICATED SIGNAL (DESCRIPTION OF EMBODIMENT 3) USING MOBILE PHONE (DETAILED CONFIGURATION OF REMOTE CONTROL INPUT DEVICE OF EMBODIMENT 3) USING MOBILE PHONE (DESCRIPTION OF EMBODIMENT 4)USING CABLE, TWO-WAY (DESCRIPTION OF EMBODIMENT 5) EXTERNAL (DESCRIPTION OF EMBODIMENT 6)SOUND COMMUNICATION (DESCRIPTION OF EMBODIMENT 7)AUTOMATIC SETTING MODE (DETAILED CONFIGURATION OF REMOTE CONTROL INPUT DEVICE OF EMBODIMENT 7)
AUTOMATIC SETTING MODE (FLOW OF THRESHOLD ADJUSTMENT OF EMBODIMENT 7) AUTOMATIC SETTING MODE (EXAMPLE OF THRESHOLD CALCULATION FUNCTION OF EMBODIMENT 7)
AUTOMATIC SETTING MODE (FLOW OF BLOCK ADJUSTMENT OF EMBODIMENT 7) AUTOMATIC SETTING MODE (DESCRIPTION OF EMBODIMENT 8) SOUND/TEXT (DETAILED CONFIGURATION OF REMOTE CONTROL INPUT DEVICE OF EMBODIMENT 8)
SOUND/TEXT (DESCRIPTION OF EMBODIMENT 9) MEASURING INSTRUMENT DATA (DETAILED CONFIGURATION OF REMOTE CONTROL INPUT DEVICE OF EMBODIMENT 9)

MEASURING INSTRUMENT DATA (DESCRIPTION OF EMBODIMENT 10)
AUXILIARY FUNCTION FOR REMOTE CONTROL INPUT DEVICE (DETAILED CONFIGURATION OF REMOTE CONTROL INPUT DEVICE OF EMBODIMENT 10)
AUXILIARY FUNCTION FOR INPUT DEVICE

INTRUSION DETECTION SYSTEM AND INTRUSION DETECTION APPARATUS

BACKGROUND OF THE INVENTION

1. Field of the Invention

The present invention relates to an intrusion detection system and an intrusion detection apparatus in which a detection signal leaked from a transmitting leaking transmission path is received at a receiving leaking transmission path, and, based on the change in the signal level of the received detection signal caused by the intrusion of an intruding object between the two transmission path, the intruding object is detected, in which, it is determined that the intruding object has intruded when, based on a table that stores a threshold for the amount of variation in the received electric wave for each of plural detection target blocks established along the transmitting leaking transmission path and the receiving leaking transmission path, the amount of variation in the received electric wave exceeds the threshold.

2. Related Art

In an intrusion detection system in the past, as shown in Patent Document 1, a detection signal leaked from a transmitting leaking transmission path is received at a receiving leaking transmission path to detect an intruding object based on the change in the signal level of the detection signal caused by the intrusion of the intruding object. The intrusion detection system calculates the amount of variation for each area, and, when the amount of variation exceeds a predetermined threshold, detects that an intruder has intruded, and issues an alert (for example, see Patent Document 1).

[Patent Literature 1] JP-A-2007-179402 (FIGS. 1 to 6 and description)

In the intrusion detection apparatus in JP-A-2007-179402, a threshold must be set for each area. In setting a threshold, an operator in a pertinent location makes a trial intrusion, and another operator in front of a detection controller watches the amount of variation in an electric field caused by the intrusion of the operator, calculates a threshold based on the value, and inputs the calculated threshold into the detection controller. In addition, when several areas are grouped into a block based on topography, the location actually corresponding to each area must be understood accurately. Also, in so doing, the operator in a pertinent location makes a trial intrusion, and the other operator in front of the detection controller watches the amount of variation in an electric field caused by the intrusion of the operator, discerns an area number corresponding to the pertinent location, and sets a block number. Accordingly, two or more operators are required for a threshold adjustment and a block adjustment, and a communication unit is required for the operators to communicate respective situations with each other.

SUMMARY OF THE INVENTION

The present invention has been made to solve the above problems, and it is an object of the present invention to allow one setting operator to readily adjust a threshold by oneself.

According to an embodiment of the present invention, an intrusion detection system in which a detection signal leaked from a transmitting leaking transmission path is received at a receiving leaking transmission path, and, based on the change in the signal level of the received detection signal caused by the intrusion of an intruding object between the two transmission path, the intruding object is detected, in which, it is determined that the intruding object has intruded when, based on a table that stores a threshold for the amount of variation in the received electric wave for each of plural detection target blocks established along the transmitting leaking transmission path and the receiving leaking transmission path, the amount of variation in the received electric wave exceeds the threshold, wherein by way of a reporting unit that issues a report to indicate the amount of variation in the received electric wave when intrusion occurred between the two transmission paths, and a remote controller that generates a signal which changes a threshold in the table through the receiving leaking transmission path, the threshold is adjusted properly for each of the blocks with the remote controller based on the report issued from the reporting unit to indicate the amount of variation in the received electric wave caused by a trial intrusion between the two transmission paths by a threshold setting operator.

According to the present invention, an intrusion detection system in which a detection signal leaked from a transmitting leaking transmission path is received at a receiving leaking transmission path, and, based on the change in the signal level of the received detection signal caused by the intrusion of an intruding object between the two transmission path, the intruding object is detected, in which, it is determined that the intruding object has intruded when, based on a table that stores a threshold for the amount of variation in the received electric wave for each of plural detection target blocks established along the transmitting leaking transmission path and the receiving leaking transmission path, the amount of variation in the received electric wave exceeds the threshold, wherein by way of a reporting unit that issues a report to indicate the amount of variation in the received electric wave when intrusion occurred between the two transmission paths, and a remote controller that generates a signal which changes a threshold in the table through the receiving leaking transmission path, the threshold is adjusted properly for each of the blocks with the remote controller based on the report issued from the reporting unit to indicate the amount of variation in the received electric wave caused by a trial intrusion between the two transmission paths by a threshold setting operator; therefore, there is an effects that one setting operator can readily adjust the threshold by oneself.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 4 is a diagram showing an example of a threshold/block table used by the intrusion detection system of FIG. 1, including an example of a corresponding pair of each area and each block that are detection target sections and an intrusion detection operation threshold for each block;

DETAILED DESCRIPTION OF THE PREFERRED EMBODIMENTS

Embodiment 1

Hereinafter, a case of an intrusion detection system which is a basic technique of the present invention will be described first, and then, Embodiment 1 of the present invention will be described.

The intrusion detection system which is a basic technique of the present invention will be described with reference to FIGS. 1 to 8, and Embodiment 1 of the present invention will be described with reference to FIGS. 9 to 18.

First, the intrusion detection system which is a basic technique of the present invention will be described with reference to FIGS. 1 to 8.

Figure 1:
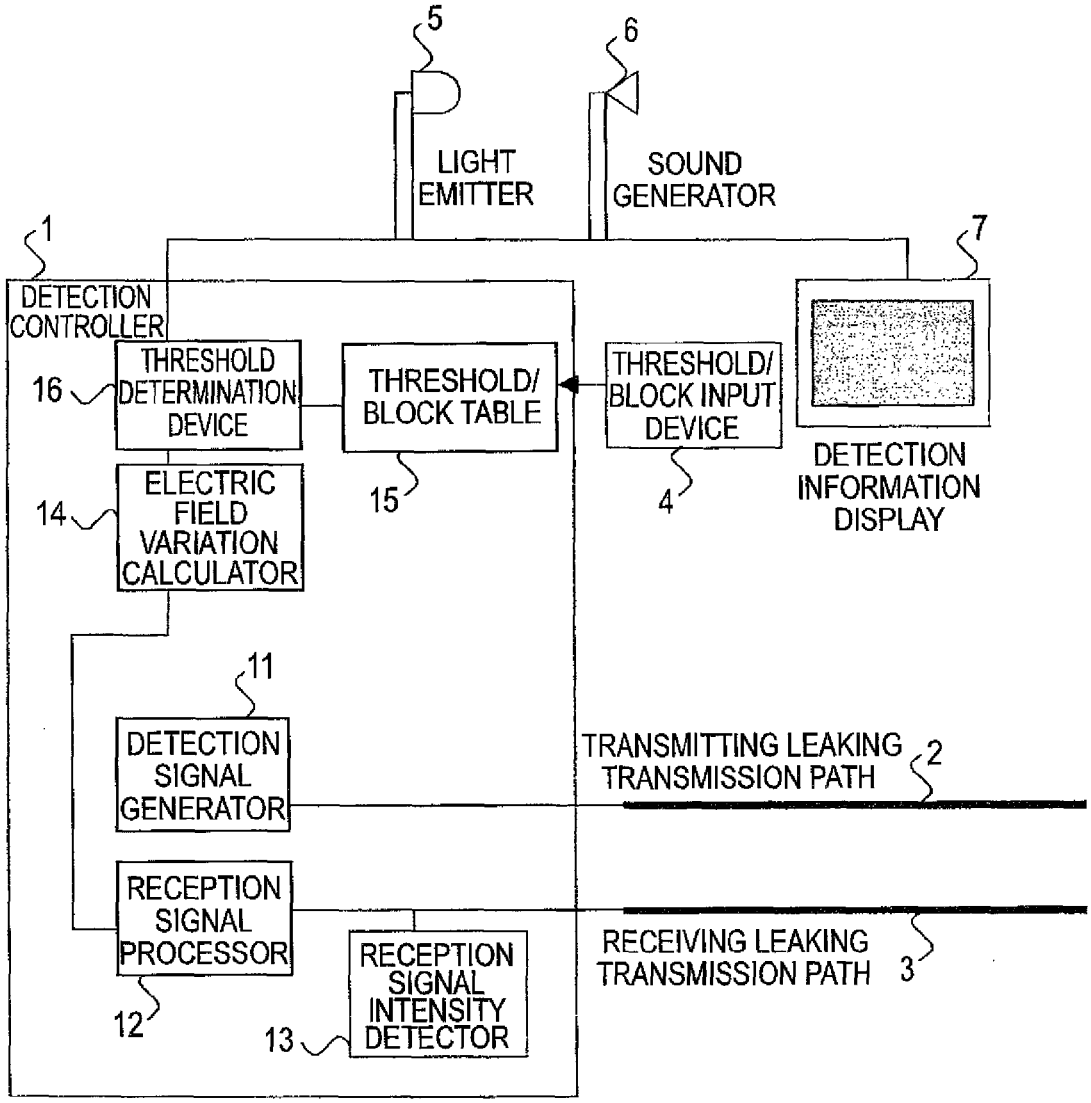
FIG. 1 is a diagram showing an example of a system configuration of an intrusion detection system which is a basic technique of the present invention.

FIG. 1 shows an example of a system configuration of an intrusion detection system which is a basic technique of the present invention.

In FIG. 1, a detection signal generator 11 generates a detection signal. The detection signal is a signal obtained by subjecting a pseudo-random sequence (PN sequence) to a BPSK (Binary Phase Shift Keying) modulation with a sine wave in the RF band. The detection signal is applied to a transmitting leaking transmission path 2 and transmitted as an electric wave. The transmitted detection signal is received by a receiving leaking transmission path 3. The signals that are to be received are received with various delay time depending on propagation paths. A reception signal processor 12 performs a correlation calculation between a reception detection signal and a transmission signal that is delayed by a predetermined time, thus allowing only a signal having a specific path length to be extracted.

Thus, it is possible to perform intruder detection for each area delimited by a path length, and to determine the intrusion area. If an intruder is near the transmitting leaking transmission path 2 or the receiving leaking transmission path 3, an electric wave is reflected and scattered by the intruder, resulting in disturbance of a detection signal that is to be received. By detecting the disturbance of the detection signal, the intruder is detected.

Next, the setting of a detection area will be described.

When areas are delimited so as to have path length differences of 10 m, the areas can be delimited every 5 m in a direction that is parallel to the transmitting leaking transmission path 2 and the receiving leaking transmission path 3. There is a demand that detection areas are organized into blocks at 10 m to 20 m intervals depending on layout situations and topography in practical operations. Thus, by associating plural areas with one block, the demand can be addressed.

Figure 2:
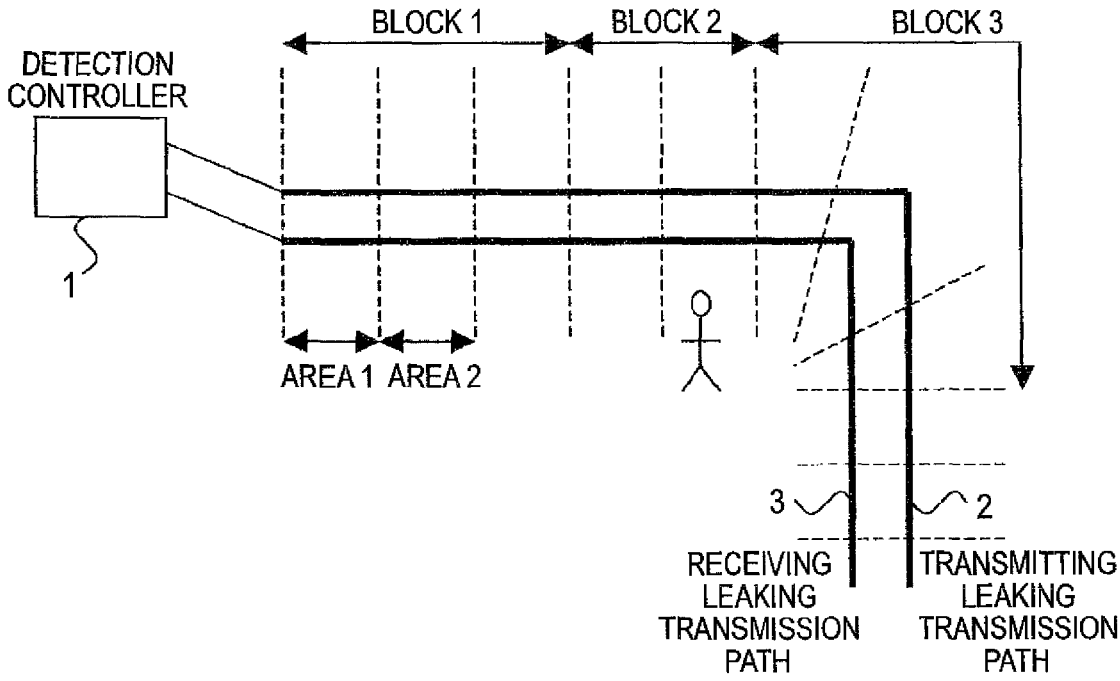
FIG. 2 is a diagram showing an example of detection areas (each of which is simply referred to as an "area" in the drawings and the following description) and detection blocks (each of which is simply referred to as a "block" in the drawings and the following description) which are detection target sections in an intrusion detection region in the intrusion detection system of FIG. 1.

FIG. 2 shows an example of the areas and the blocks that are detection target sections in an intrusion detection region in the intrusion detection system of FIG. 1.

Figure 3:
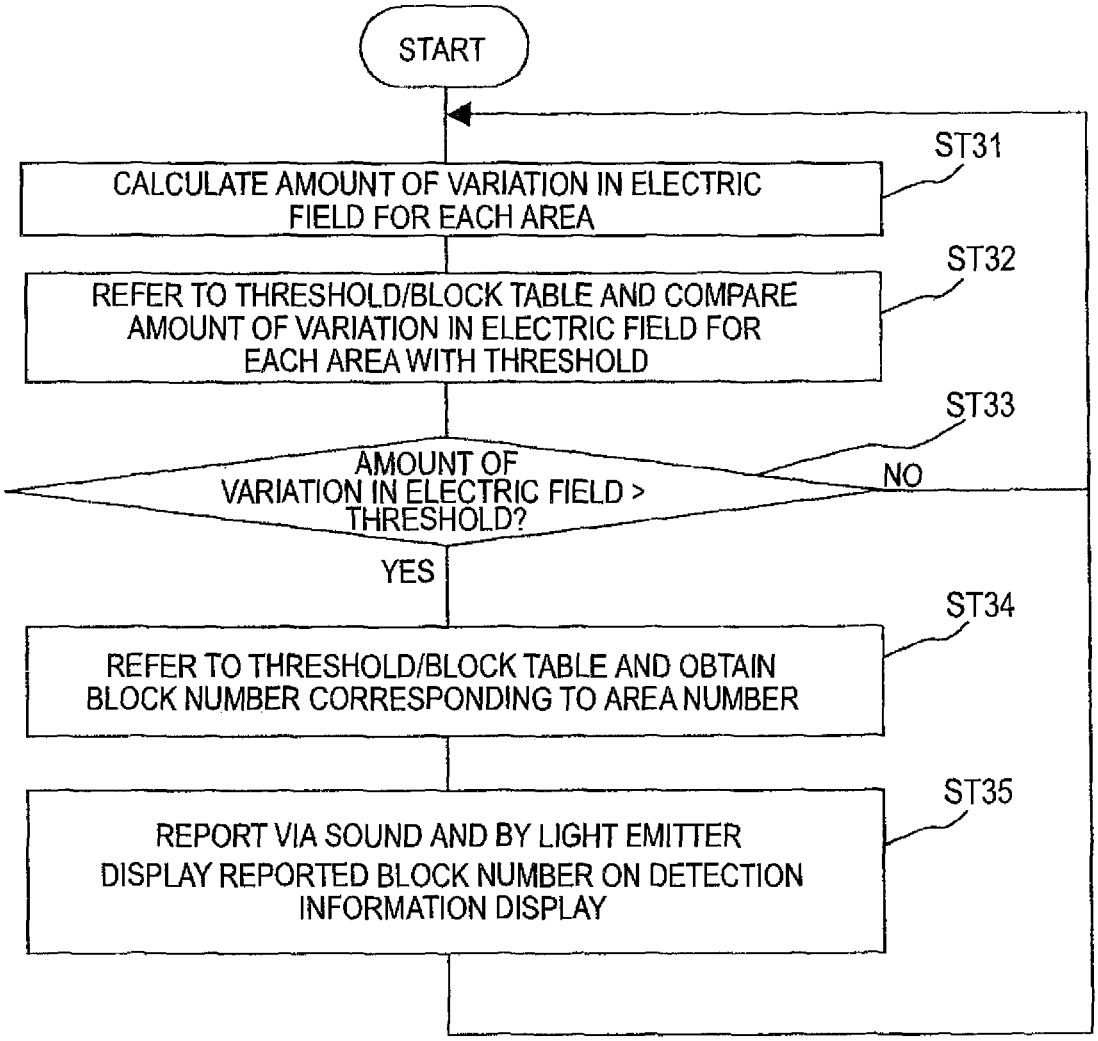
FIG. 3 is a flow chart showing an example of the intrusion detection report operation in the intrusion detection system of FIG. 1.

FIG. 3 is a flow chart showing an example of the intrusion detection report operation in the intrusion detection system of FIG. 1.

An example of the intrusion detection report operation in the intrusion detection system of FIG. 1 will be described below with reference to FIG. 3.

In each area, the magnitude of the disturbance of the detection signal that is to be received is calculated by an electric field variation calculator 14 as the amount of variation in an electric field (step ST31).

A threshold determination device 16 compares the amount of variation in the electric field calculated by the electric field variation calculator 14 with a detection determination threshold entered by a threshold/block input device 4 in advance and stored in a threshold/block table 15 (step ST32), and as a result of the comparison, when the amount of variation in the electric field is larger than the detection determination threshold (step ST 33), it is determined that an intruder exists, and a report is issued. The report is notified by a detection information display 7, a sound generator 6 and a light emitter 5 to a guard and the intruder (step ST35). In addition, a block number which corresponds to the area number where the report was issued is determined by referring to the threshold/block table 15 (step ST34), and displayed on the detection information display 7 (step ST35). For example, when the threshold/block table is as depicted in FIG. 4, and the amount of variation in an electric field for each area is as depicted in FIG. 5, as is clear from FIGS. 4 and 5, block No. 2, area No. 5 is reported.

Figure 5:
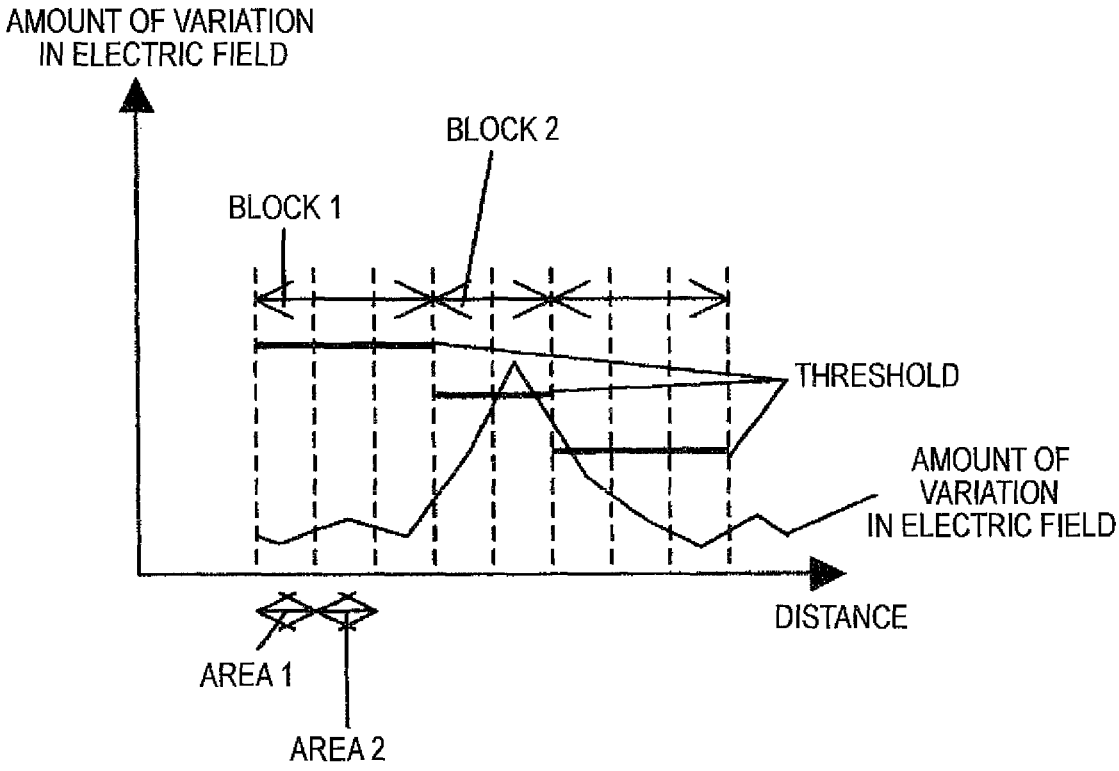
FIG. 5 is an explanation drawing illustrating intrusion detection based on the relationship between the amount of variation in an electric field caused by an intrusion and a threshold for each block in the intrusion detection system of FIG. 1.

Note that FIG. 4 is a diagram showing an example of a threshold/block table used by the intrusion detection system of FIG. 1, including an example of a corresponding pair of each area and each block that are detection target sections and an intrusion detection operation threshold for each block, and FIG. 5 is an explanation drawing illustrating intrusion detection based on the relationship between the amount of variation in an electric field caused by an intrusion and a threshold for each block in the intrusion detection system of FIG. 1.

The device that includes the detection signal generator 11, the reception signal processor 12, the electric field variation calculator 14 and the threshold determination device 16 is a detection controller 1.

In such an intrusion detection apparatus and an intrusion detection system, owing to differences in the intrinsic properties of the leaking cables used for the transmitting leaking transmission path 2 and the receiving leaking transmission path 3, and to differences in the environments in which the transmitting leaking transmission path 2 and the receiving leaking transmission path 3 are laid out (for example, for each intrusion detection system, differences in the environment of whether the layout location is earth or concrete, differences in the kind of surrounding building structure, differences in the length of the laid out leaking cable, and the like), the intensity of the electric field received for each area varies, varying the magnitude of the variation in the electric wave generated by an intruder for each area, thus, it is desirable that the detection determination threshold for each area or each block is set to a proper detection determination threshold allowing an intrusion to be detected accurately for each intrusion detection apparatus and intrusion detection system, and not set to a preset fixed value.

As described above, if the configuration is such that the threshold determination device 16 compares the amount of variation in the electric field calculated by the electric field variation calculator 14 with a detection determination threshold entered by the threshold/block input device 4 in advance and stored in the threshold/block table 15 (step ST32), and as a result of the comparison, when the amount of variation in the electric field is larger than the detection determination threshold (step ST 33), it is determined that an intruder exists, the detection determination threshold for each area or each block in the threshold/block table 15 can be set to a proper detection determination threshold allowing an intrusion to be detected accurately for each intrusion detection apparatus and intrusion detection system.

Figure 6:
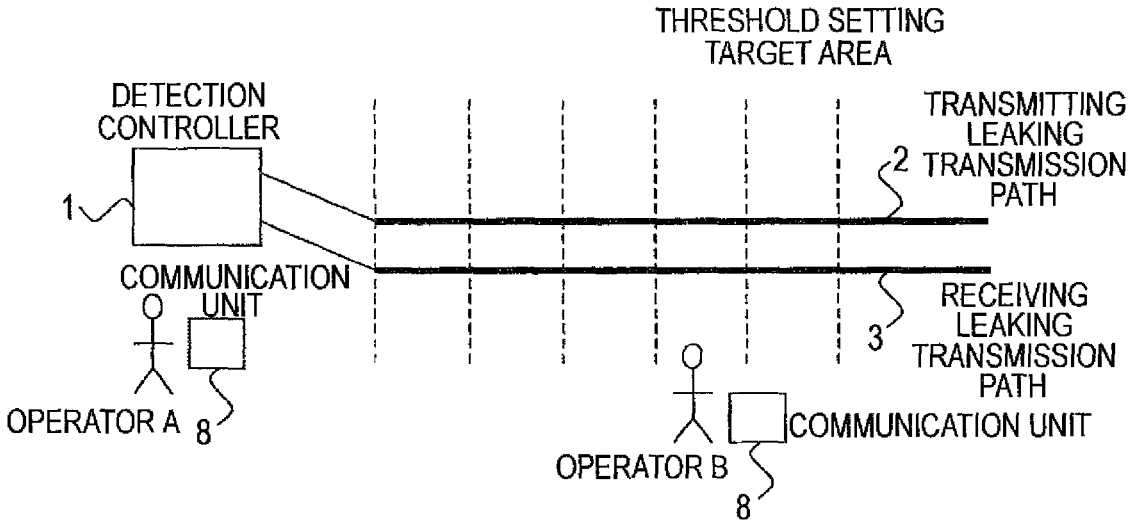
FIG. 6 is a diagram illustrating an example of a concept regarding the setting of a proper detection determination threshold by which an intrusion can be detected accurately in the intrusion detection system of FIG. 1.
Figure 7:
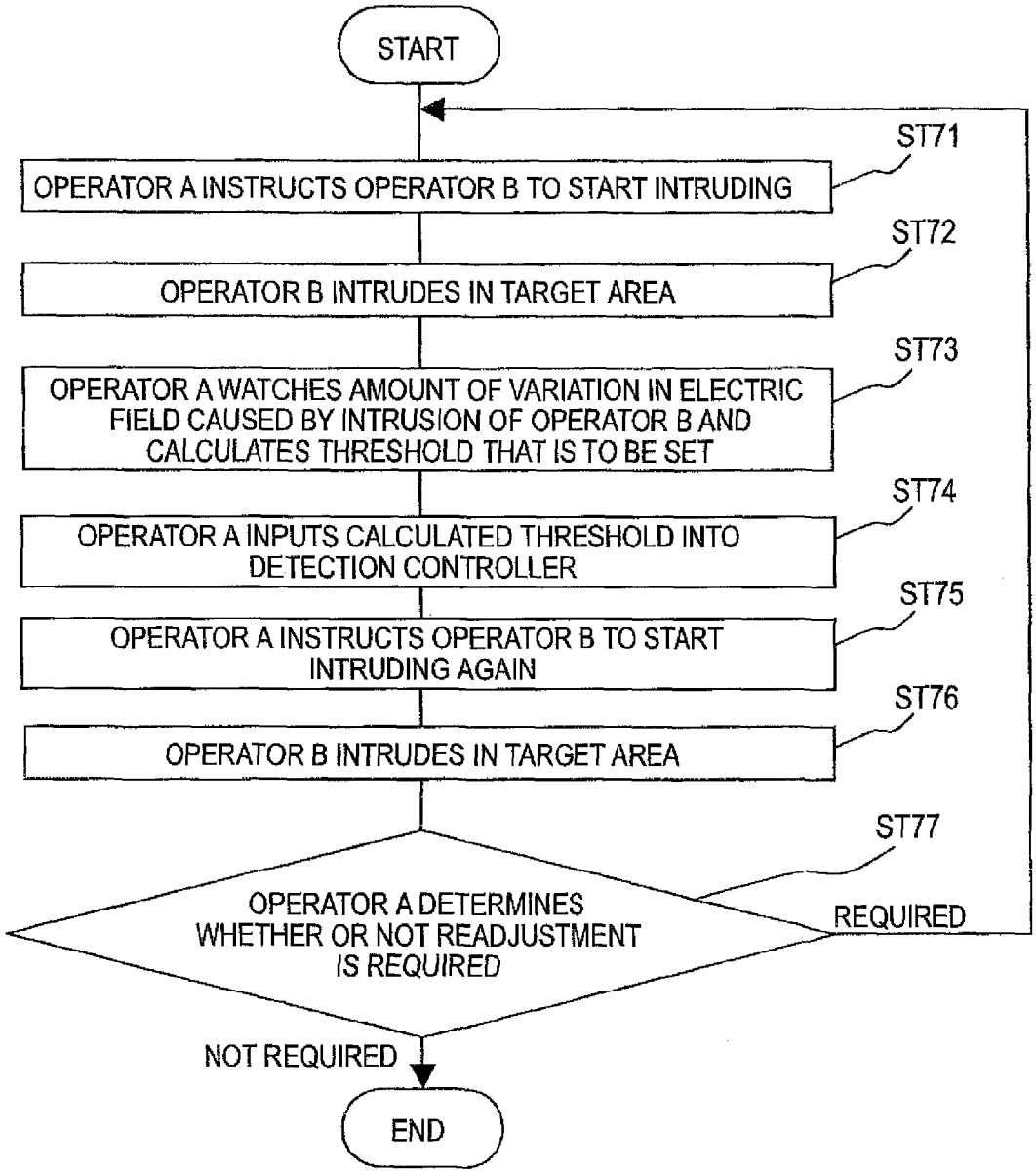
FIG. 7 is a flow chart of a threshold setting procedure illustrating an example of a concept regarding the setting of a proper detection determination threshold by which an intrusion can be detected accurately in the intrusion detection system of FIG. 1.

FIG. 6 shows an example of a concept regarding the setting of a proper detection determination threshold by which an intrusion can be detected accurately for each intrusion detection apparatus and intrusion detection system, and FIG. 7 is a flowchart of a threshold setting procedure illustrating an example of the concept.

As illustrated in FIGS. 6 and 7, an operator A instructs an operator B to start intruding (step ST71). Following the instruction, the operator B makes a trial intrusion into the instructed area near the transmitting leaking transmission path 2 and the receiving leaking transmission path 3 and targeted for threshold adjustment (step ST72), and the operator A calculates a threshold that is to be set based on the amount of variation in the reception electric field caused by this trial intrusion (step ST73).

The operator A inputs the calculated threshold into the detection controller 1 (step ST74). That is to say, the calculated threshold is set in the threshold/block table 15 of the detection controller 1 as shown in FIG. 4, for example.

Next, the operator A instructs the operator B to start intruding again (step ST75).

The operator B intrudes in a target area (step ST76).

The operator A determines whether or not readjustment is required (step ST77).

As a result of the determination by the operator A as to whether or not readjustment is required in step ST77, if readjustment is not required, the threshold setting for the area where the operator B made a trial intrusion is finished.

As a result of the determination by the operator A as to whether or not readjustment is required in step ST77, if readjustment is required, processing from steps ST71 to ST77 is performed again.

The operator A has to watch the change in the amount of variation in the electric field caused by the intrusion of the operator B on the detection information display 7, therefore, the operator A has to be in a range where the operator A can check the detection information display 7. The detection controller 1 is placed on a panel inside or outside of a building that is to be a supervision base, and located 10 to 100 m apart from the starting points of the transmitting leaking transmission path 2 and the receiving leaking transmission path 3. Therefore, the operator B cannot be the operator A at the same time.

Therefore, at least two operators; the operator B who makes a trial intrusion in an area targeted for a threshold adjustment, and the operator A who watches the amount of variation in the electric field caused by the intrusion of the operator B, and displayed on the detection information display 7, calculates a threshold, and inputs the calculated threshold into the detection controller 1 through the threshold/block input device 4, have to perform the setting task of the proper detection determination threshold allowing the intrusion to be detected accurately. In addition, a communication unit 8 is required for the operator A and the operator B to communicate with each other.

Figure 8:
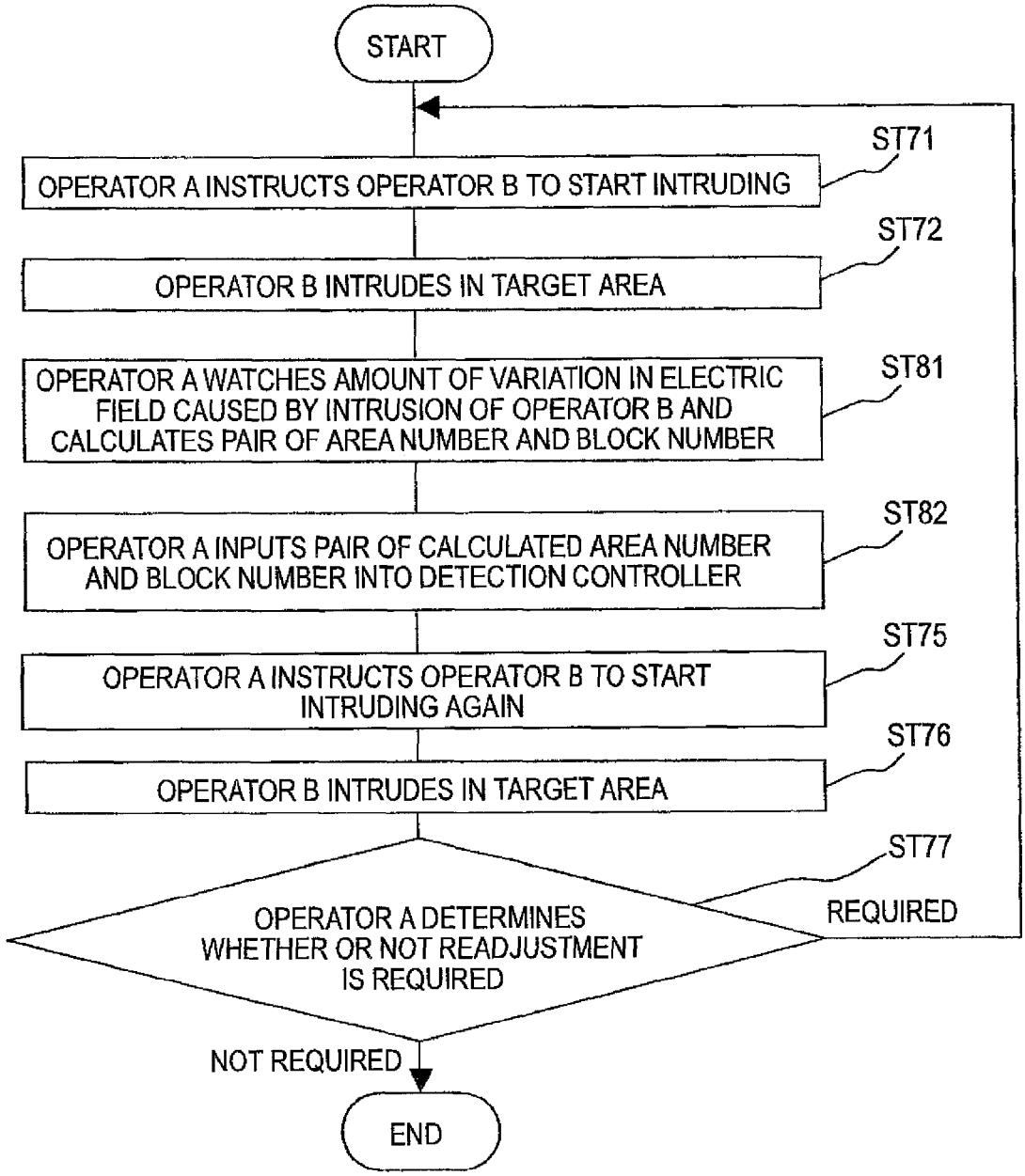
FIG. 8 is a flow chart illustrating the adjustment procedure of the block of a threshold setting target in the intrusion detection system of FIG. 1.

FIG. 8 is a flow chart illustrating the adjustment procedure of the block targeted for threshold setting in the intrusion detection system.

Similarly, two or more operators have to perform a block adjustment since the operator B intrudes, and the operator A discerns a corresponding pair of the area number where the amount of variation in the electric field increases, which is caused by the intrusion of the intruder, and the block number where the operator B exists, and sets the block number.

In this procedure, as the procedure illustrated in FIG. 8, first, the operator A instructs the operator B to start intruding (step ST71).

The operator B intrudes in a target area (step ST72).

The operator A calculates a corresponding pair of the area number where the amount of variation in the electric field increases caused by the intrusion of the operator B and the block number (step ST81).

The operator A inputs a corresponding pair of the calculated area number and block number into the detection controller 1 (step ST82). That is to say, a corresponding pair of the calculated area number and block number is set in the threshold/block table 15 of the detection controller 1 as shown in FIG. 4, for example.

Next, the operator A instructs the operator B to start intruding again (step ST75).

The operator B intrudes in a target area (step ST76).

The operator A determines whether or not readjustment is required (step ST77).

As a result of the determination by the operator A as to whether or not readjustment is required in step ST77, if readjustment is not required, the adjustment and setting of the block for the area where the operator B made a trial intrusion are finished.

As a result of the determination by the operator A as to whether or not readjustment is required in step ST77, if readjustment is required, processing of steps ST71, ST72, ST81, ST82, ST75, ST76 and ST77 is performed again.

In the case illustrated in FIGS. 1 to 8, as described above, at least two operators; the operator B who makes a trial intrusion in an area targeted for a threshold adjustment, and the operator A who watches the amount of variation in the electric field caused by the intrusion of the operator B, and displayed on the detection information display 7, calculates a threshold, and inputs the calculated threshold into the detection controller 1 through the threshold/block input device 4, have to perform the setting task of the proper detection determination threshold allowing the intrusion to be detected accurately. Similarly, two or more operators have to perform a block adjustment since the operator B intrudes, and the operator A discerns a corresponding pair of the area number where the amount of variation in the electric field increases, which is caused by the intrusion of the intruder, and the block number where the operator B exists, and sets the block number. In addition, the communication unit 8 is required for the operator A and the operator B to communicate with each other.

According to Embodiment 1, one operator can perform the threshold adjustment task and the block adjustment task by oneself.

In addition, in the case illustrated in FIGS. 1 to 8, since a weak electric wave is used for the detection signal in this intrusion detection apparatus, if a powerful electric wave exists in the vicinity, the receiver becomes saturated and incapable of detecting a signal, therefore, in order to sense this detection-incapacitated state, the intensity of the received signal has to be watched by a reception signal intensity detector 13. According to Embodiment 1, information transmission means required for remote control is achieved by using the reception signal intensity detector 13.

Embodiment 1 will now be described with reference to FIGS. 9 to 18.

Figure 9:
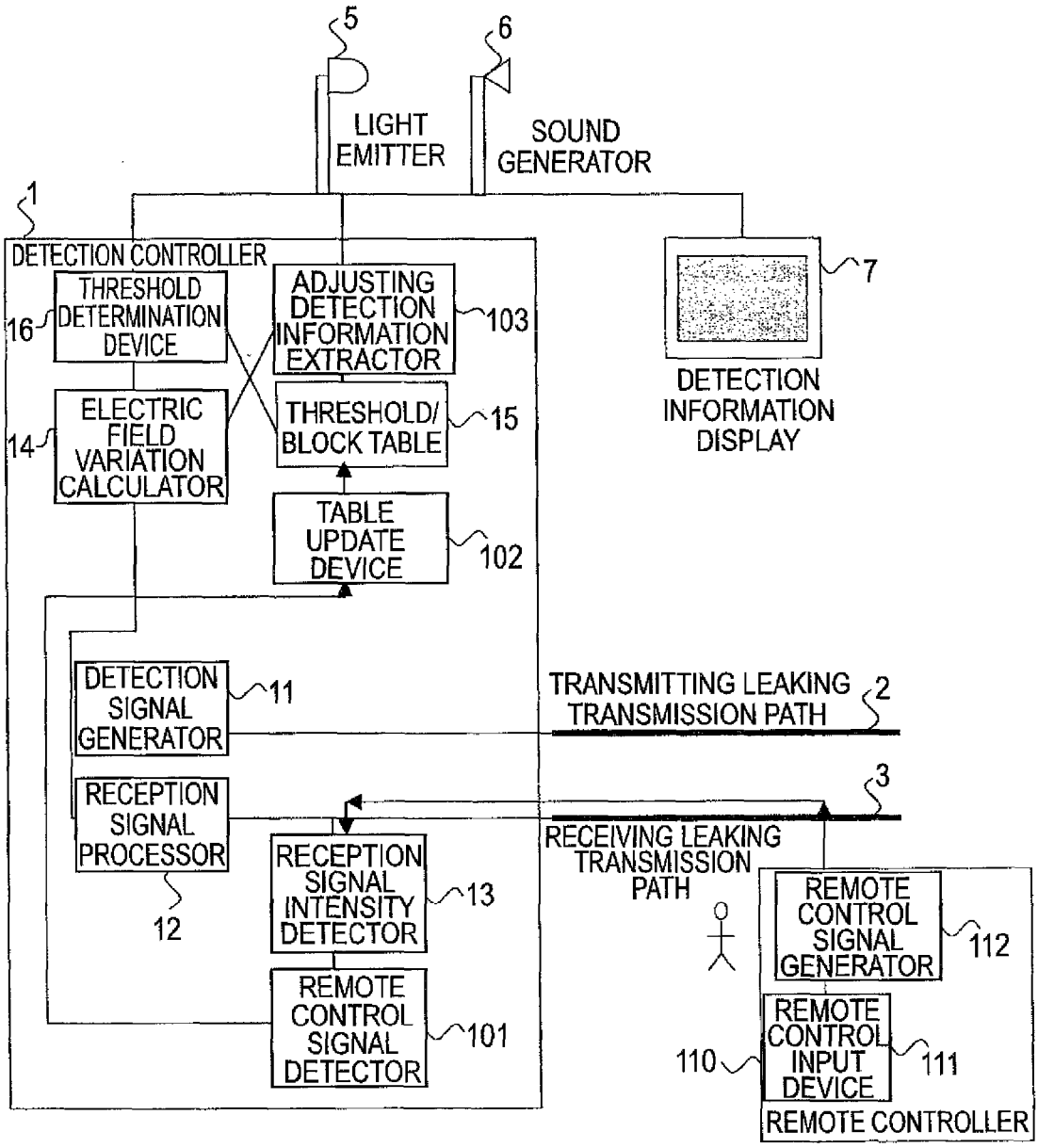
FIG. 9 is a diagram showing an example of a system configuration of an intrusion detection system according to Embodiment 1 of the present invention.
Figure 10:
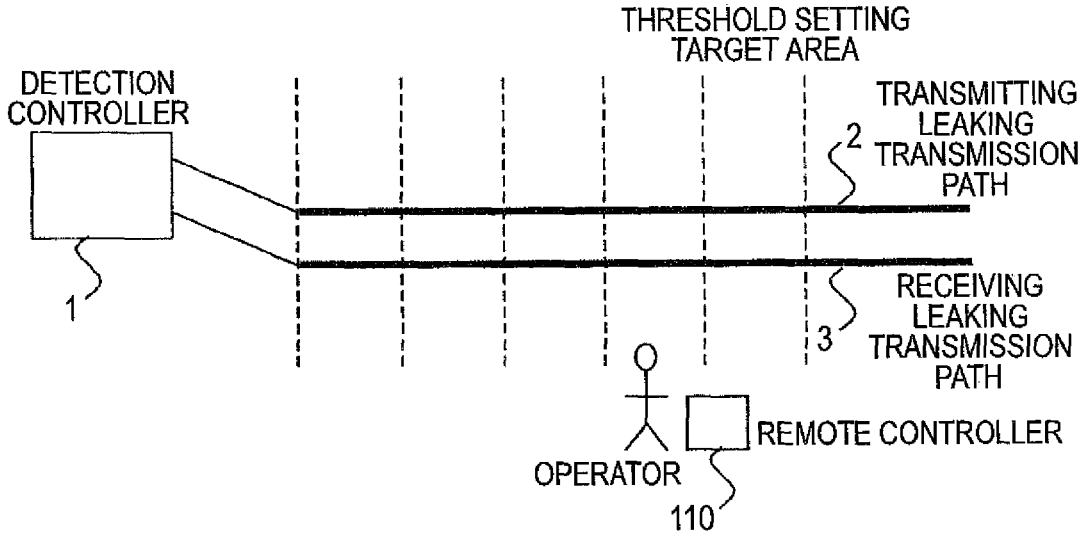
FIG. 10 is a diagram illustrating an example of a concept regarding a threshold setting in the intrusion detection system of FIG. 9 according to Embodiment 1 of the present invention.
Figure 11:
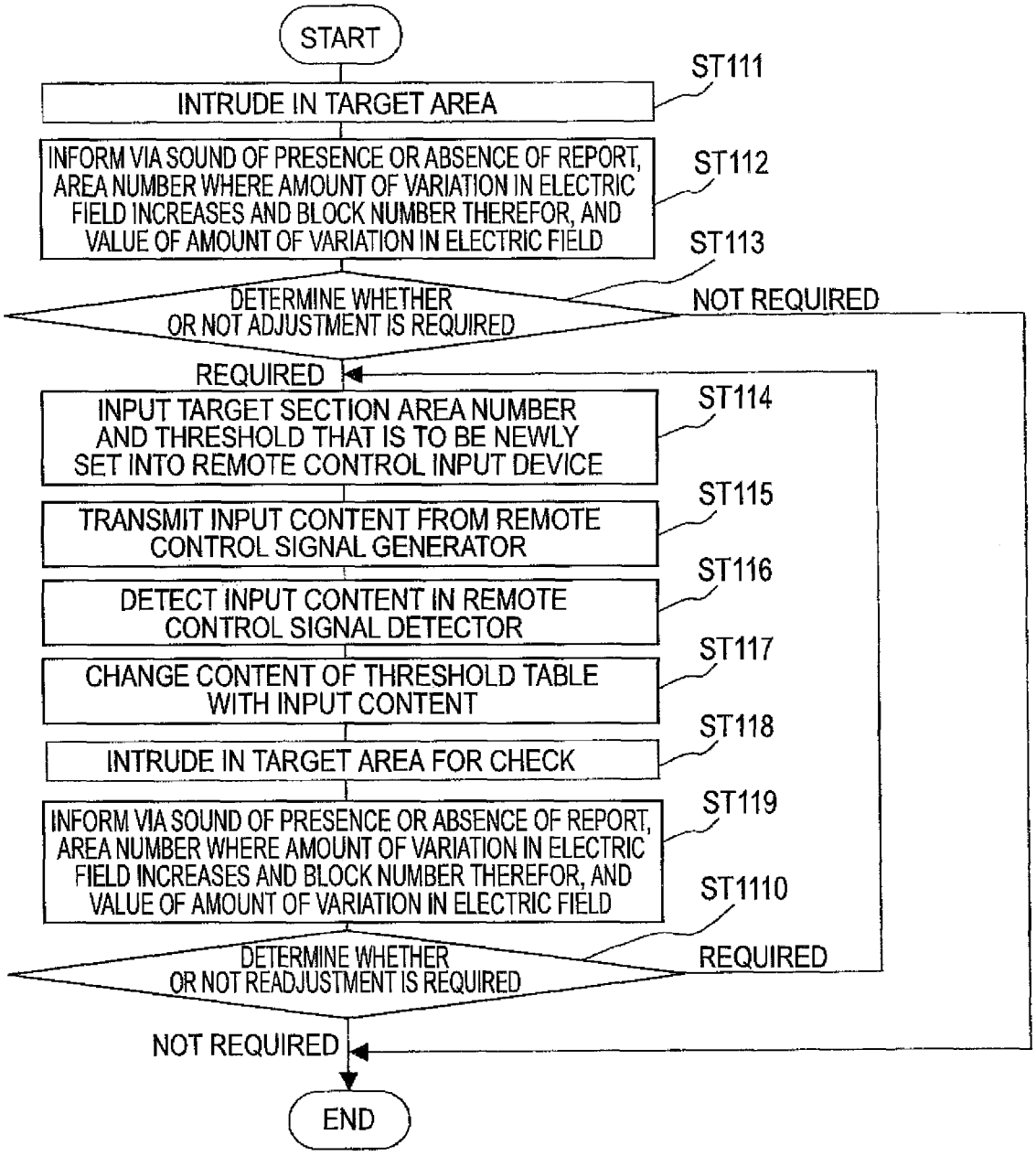
FIG. 11 is a flow chart illustrating a threshold setting adjustment procedure for each block in the intrusion detection system of FIG. 9 according to Embodiment 1 of the present invention.

FIG. 9 shows an example of a system configuration of an intrusion detection system according to Embodiment 1. FIG. 10 is a diagram illustrating an example of a concept regarding a threshold setting in the intrusion detection system of FIG. 9. FIG. 11 is a flow chart illustrating a threshold setting adjustment procedure for each block in the intrusion detection system of FIG. 9.

The setting operator carrying a remote controller 110 intrudes into a detection target area, and checks whether or not a report is issued. The operator discerns whether or not a report has been issued via a sound generated by the sound generator 6 or via the illumination of light emitted from the light emitter 5 at the time when a report is issued.

Specifically, an adjusting detection information extractor 103 extracts the area number and the block number where the setting operator has intruded, and the amount of variation in the electric field caused by the intrusion from the threshold/block table 15 and the electric field variation calculator 14. The extracted area number, block number and amount of variation in the electric field are reported via a sound generated by the sound generator 6, and the intruding setting operator is informed by this reporting, of the area number and the block number where the setting operator has intruded, and the amount of variation in the electric field caused by the intrusion.

When the setting operator intrudes, the setting operator checks whether or not a report is issued, and inputs a threshold that is to be set based on the amount of variation in the electric field when the report is issued into a remote control input device 111 in the remote controller 110. The input operation into the remote control input device 111 causes the remote control signal generator 112 to transmit a remote control signal. Thereafter, information transmission means described later transmits information to the detection controller 1. The detection controller 1 stores into the threshold/block table 15, a new threshold for the area specified by the information transmitted by the remote control signal. After setting, the setting operator intrudes again to check that a report is issued. If no report is issued, a threshold setting is performed again through the above procedure.

Next, transmission means of remote control information according to Embodiment 1 will be described.

Figure 12:
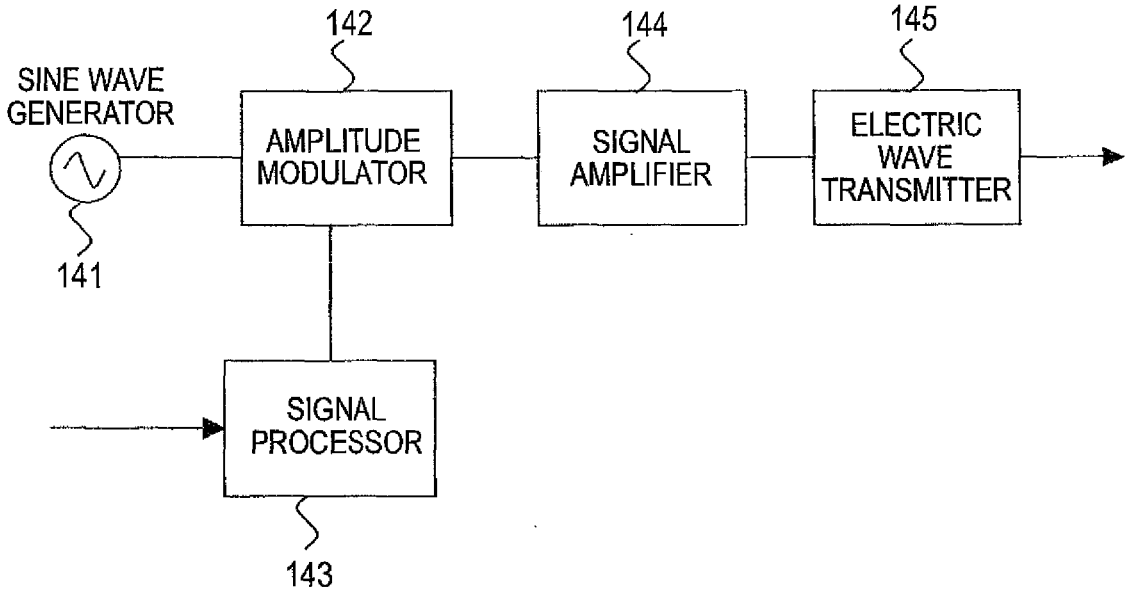
FIG. 12 is a block diagram showing an example of a detailed configuration of a remote control signal generator in the intrusion detection system of FIG. 9 according to Embodiment 1 of the present invention.

FIG. 12 is a block diagram showing an example of a detailed configuration of the remote control signal generator 112 in the intrusion detection system of FIG. 9.

A sine wave signal in the RF band is generated by a sine-wave generator 141. An amplitude modulator 142 into which the sine wave signal is entered is controlled by a signal processor 143 to generate a remote control signal for transmission in which the intensity is changed depending on the digital data transmitted to the detection controller 1, for example, with such specific patterns as PN codes. The remote control signal for transmission generated by the amplitude modulator 142 is amplified by a signal amplifier 144, and the amplified remote control signal for transmission is transmitted by an electric wave transmitter 145 to the receiving leaking transmission path 3 as an electric wave.

Figure 13:
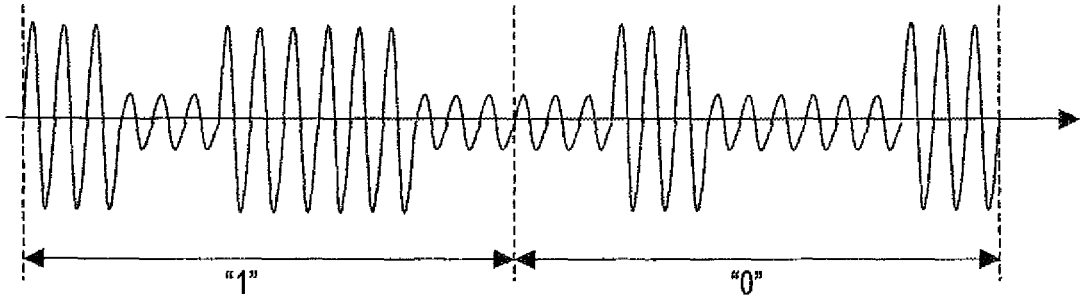
FIG. 13 is a diagram showing an example of a remote control signal transmission waveform in the intrusion detection system of FIG. 9 according to Embodiment 1 of the present invention.

FIG. 13 shows an example of the remote control signal transmitted by the electric wave transmitter 145.

The remote control signal for transmission transmitted by the electric wave transmitter 145 to the receiving leaking transmission path 3 as an electric wave is a signal having almost the same intensity as that of the detection signal emitted by the transmitting leaking transmission path 2 during normal use.

The remote control signal for transmission transmitted to the receiving leaking transmission path 3 as an electric wave is received by the receiving leaking transmission path 3 and combined with the detection signal, which is in turn received by the detection controller 1 through the receiving leaking transmission path 3.

Since the change in the detection signal caused by the intrusion of the setting operator is limited to the change in the part of a propagation path, the change in the signal intensity of the entire detection signal received by the detection controller 1 is extremely small compared with the change in the remote control signal for transmission transmitted to the receiving leaking transmission path 3 as an electric wave, and the signal received by the detection controller 1 changes as the intensity of the remote control signal changes. Accordingly, a remote control signal can be detected by detecting only the change in the intensity of the received signal without demodulating the remote control signal in the RF band into a baseband signal, which can be achieved with a simple circuit.

Figure 14:
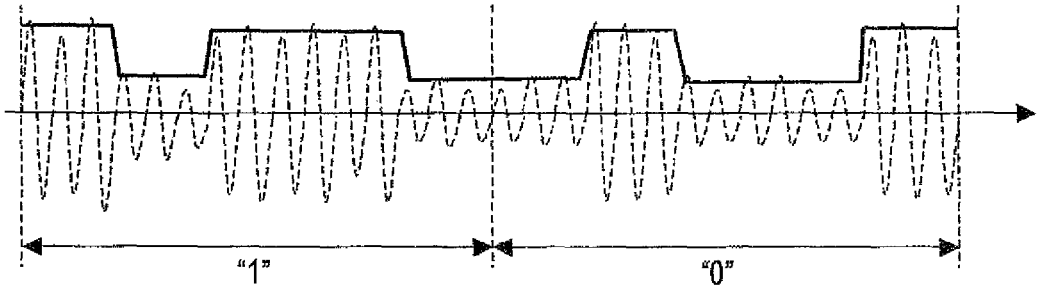
FIG. 14 is a diagram showing an example of a remote control signal reception waveform in the intrusion detection system of FIG. 9 according to Embodiment 1 of the present invention.

The intensity of the received signal is detected by the reception signal intensity detector 13. FIG. 14 shows an example of the change in the intensity of the received signal detected by the reception signal intensity detector 13.

A remote control signal detector 101 checks whether or not the change in the intensity of the received signal detected by the reception signal intensity detector 13 matches a specific pattern, detects the remote control signal and decodes data transmitted by the remote control signal generator 112.

Next, the input procedure to the remote control input device 111 will be described with reference to FIGS. 15 and 16.

Figure 15:
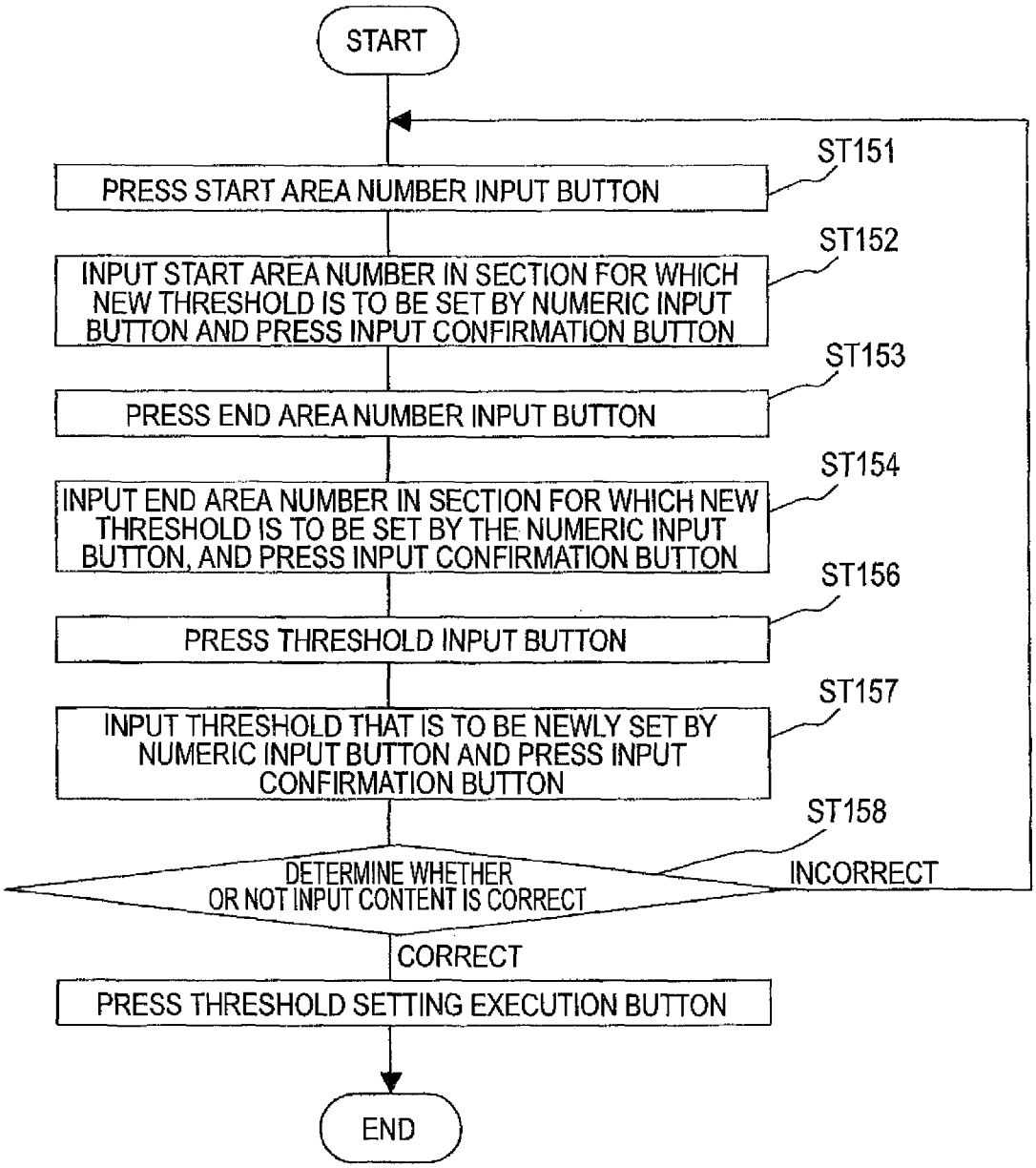
FIG. 15 is a flow chart showing an example of an operation procedure of a threshold adjustment and an adjustment threshold input according to Embodiment 1 of the present invention.
Figure 16:
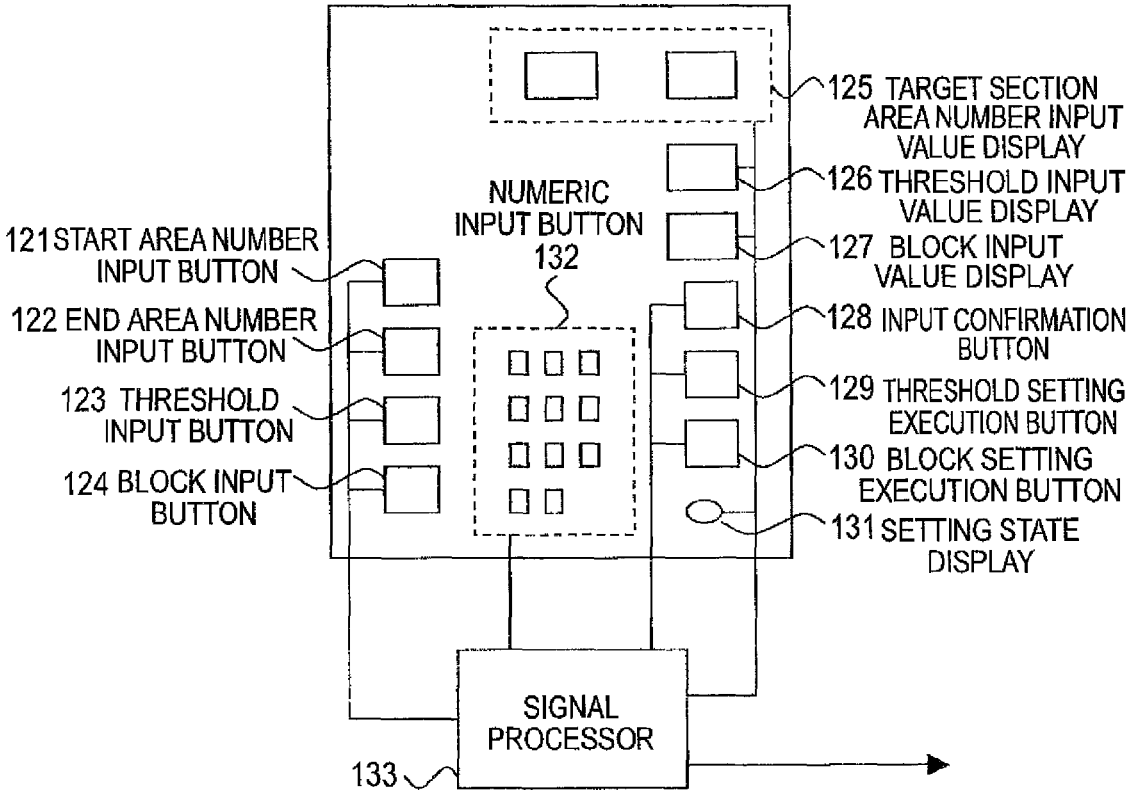
FIG. 16 is a diagram showing an example of a detailed configuration of a remote control input device in the intrusion detection system of FIG. 9 according to Embodiment 1 of the present invention.

FIG. 15 is a flow chart showing an example of an operation procedure of a threshold adjustment and an adjustment threshold input. FIG. 16 is a diagram showing an example of a detailed configuration of the remote control input device 111 in the intrusion detection system of FIG. 9.

The setting operator presses a start area number input button 121 (step ST151), inputs the start area number in the section for which a new threshold is to be set by a numeric input button 132, and presses an input confirmation button 128 (step ST152) to confirm the input content.

Next, the setting operator presses an end area number input button 122 (step ST153), inputs the end area number in the section for which a new threshold is to be set by the numeric input button 132, and presses the input confirmation button 128 (step ST154) to confirm the input content.

Next, the setting operator presses a threshold input button 123 (step ST155), inputs the threshold for the section for which a new threshold is set by the numeric input button 132, and presses the input confirmation button 128 (step ST156) to confirm the input content.

The input content is displayed on a target section area number input value display 125 and a threshold input value display 126. The setting operator checks whether or not the input content matches the intended one (step ST157) and presses a threshold setting execution button 129 (step ST158).

When the threshold setting execution button 129 is pressed, a signal processor 133 creates a transmission data sequence based on the input content and transmits the sequence to the remote control signal generator 112.

An information display 131 is constituted by an LED, and controlled by the signal processor 133 to light up while electric wave transmission is being performed by the remote control signal generator 112 to inform the setting operator that transmission is being performed.

Next, the block adjustment procedure of Embodiment 1 will be described with reference to FIG. 17.

Figure 17:
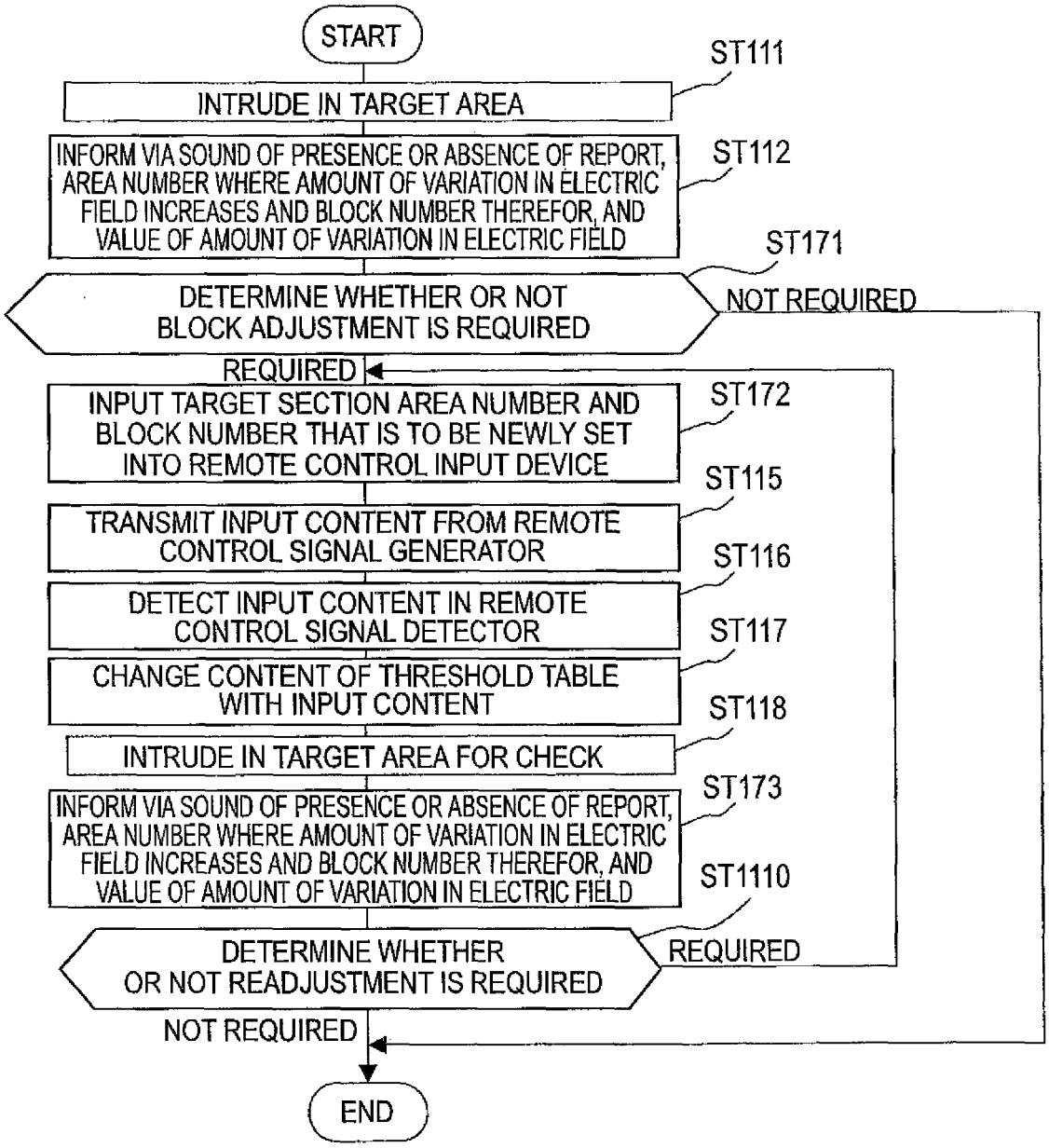
FIG. 17 is a flow chart showing an example of an adjustment procedure of a block that is a detection target section according to Embodiment 1 of the present invention.

FIG. 17 is a flow chart showing an example of an adjustment procedure of a block that is a detection target section.

The setting operator carrying the remote controller 110 intrudes into the area that is to be a detection target area (step ST111).

The area number and the block number where the setting operator exists, and the value of the amount of variation in the electric field (variation level value) are informed to the setting operator via a sound generated by the sound generator 6 (step ST112).

Based on the informed area number and block number, the setting operator determines whether or not the block has to be adjusted (step ST171), and if needed, inputs the area number in the target section and the block number that is to be set into the remote control input device 111 (step ST172).

The input operation into the remote control input device 111 causes the remote control signal generator 112 to transmit a remote control signal (step ST115). Thereafter, the information transmission means transmits information to the detection controller 1.

The detection controller 1 stores into the threshold/block table 15, a new block number for the area specified by the information transmitted by the remote control signal (steps ST116 and ST117).

After setting, the setting operator intrudes again (step ST118) to check that a new block number is set (steps ST173 and ST1110). If readjustment is required (step ST1110), a block adjustment is performed through the above procedure.

Next, the input procedure to the remote control input device 111 in the block adjustment will be described with reference to FIG. 18.

Figure 18:
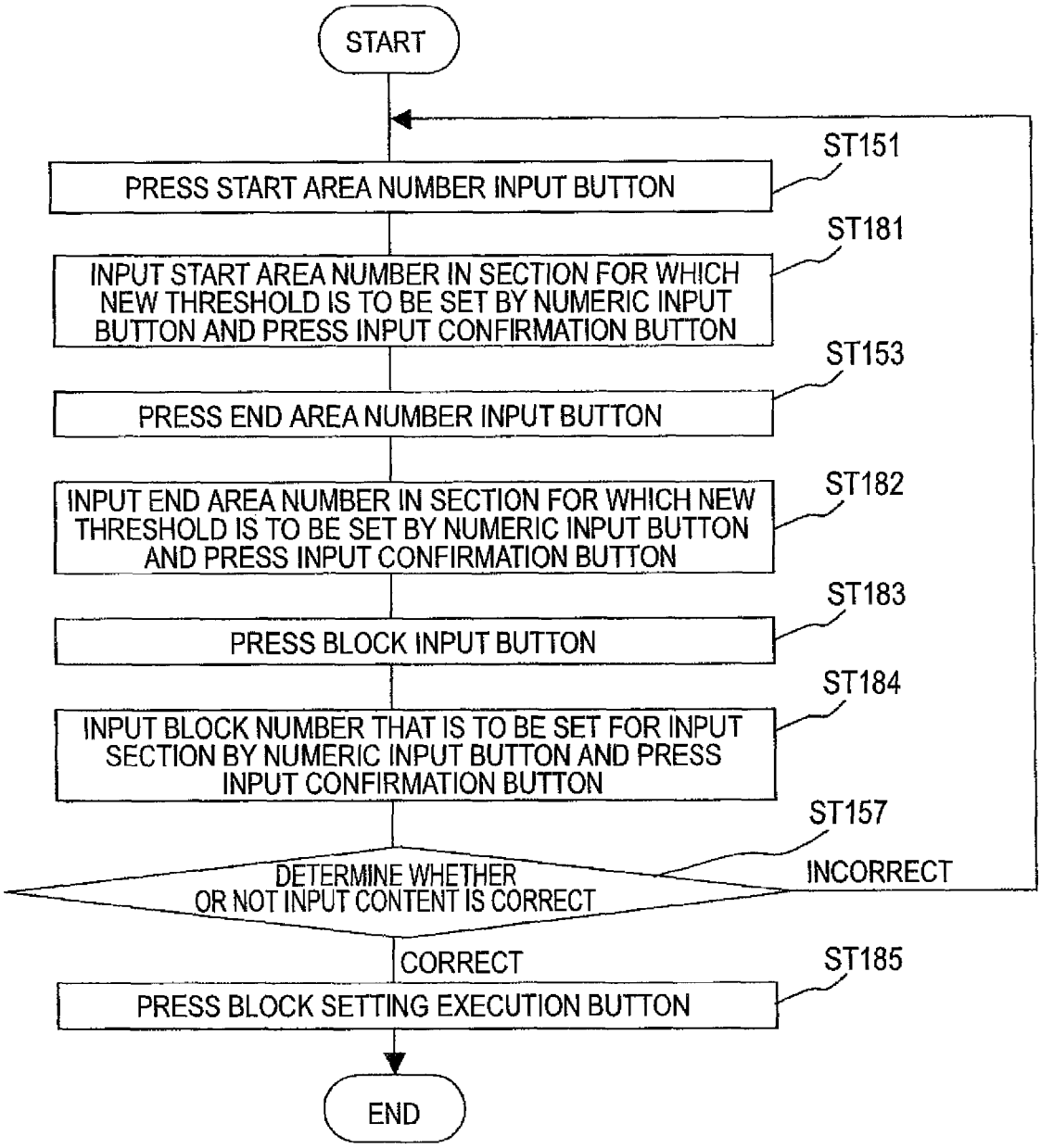
FIG. 18 is a flow chart showing an example of an input procedure of a block adjustment according to Embodiment 1 of the present invention.

FIG. 18 is a flow chart showing an example of an input procedure of a block adjustment. FIG. 16 shows a detailed configuration of the remote control input device 111.

The setting operator presses a start area number input button 121 (step ST151), inputs the start area number in the section for which a new threshold is set by a numeric input button 132, and presses an input confirmation button 128 (step ST181) to confirm the input content.

Next, the setting operator presses an end area number input button 122 (step ST153), inputs the end area number in the section for which a new threshold is set by the numeric input button 132, and presses the input confirmation button 128 (step ST182) to confirm the input content.

Next, the setting operator presses a block input button 124 (step ST183), inputs a block number that is to be newly set by the numeric input button 132, and presses the input confirmation button 128 (step ST184) to confirm the input content.

The input content is displayed on a target section area number input value display 125 and a block input value display 127. The setting operator checks whether or not the input content matches the intended one (step ST157) and presses a block setting execution button 130 (step ST185).

When the block setting execution button 130 is pressed, the signal processor 133 creates a transmission data sequence based on the input content and transmits the sequence to the remote control signal generator 112. An information display 131 is constituted by an LED, and controlled by the signal processor 133 to light up while electric wave transmission is being performed by the remote control signal generator 112 to inform the setting operator that transmission is being performed.

Note that the remote control input device 111 is connected to the remote control signal generator 112 by data transmission means such as a USB, so that the above function may be achieved by a program on a PC including information input means such as a keyboard and a mouse and information display means.

The device that includes the remote control input device 111 and the remote control signal generator 112 is the remote controller 110.

Such a configuration allows one operator to perform the threshold adjustment task and the block adjustment task by oneself as described above.

In addition, since this configuration is such that remote control signal for transmission is transmitted to the receiving leaking transmission path 3, not to the transmitting leaking transmission path 2, as an electric wave, so as to detect the remote control signal received by the receiving leaking transmission path 3, a remote control signal can be transmitted with extremely small power compared with the case where the signal is transmitted to the transmitting leaking transmission path 2, which can be achieved with transmission intensity within the radio law.

Note that if a remote control signal for transmission is transmitted to the transmitting leaking transmission path 2 as an electric wave, a signal having almost the same intensity as that of the detection signal emitted by the detection signal generator 11 has to be received; therefore, the remote control signal has to be transmitted with much larger power compared with the case where the remote control signal for transmission is transmitted to the receiving leaking transmission path 3 as an electric wave.

Embodiment 2

Embodiment 2 will now be described with reference to FIGS. 19 to 25.

Figure 19:
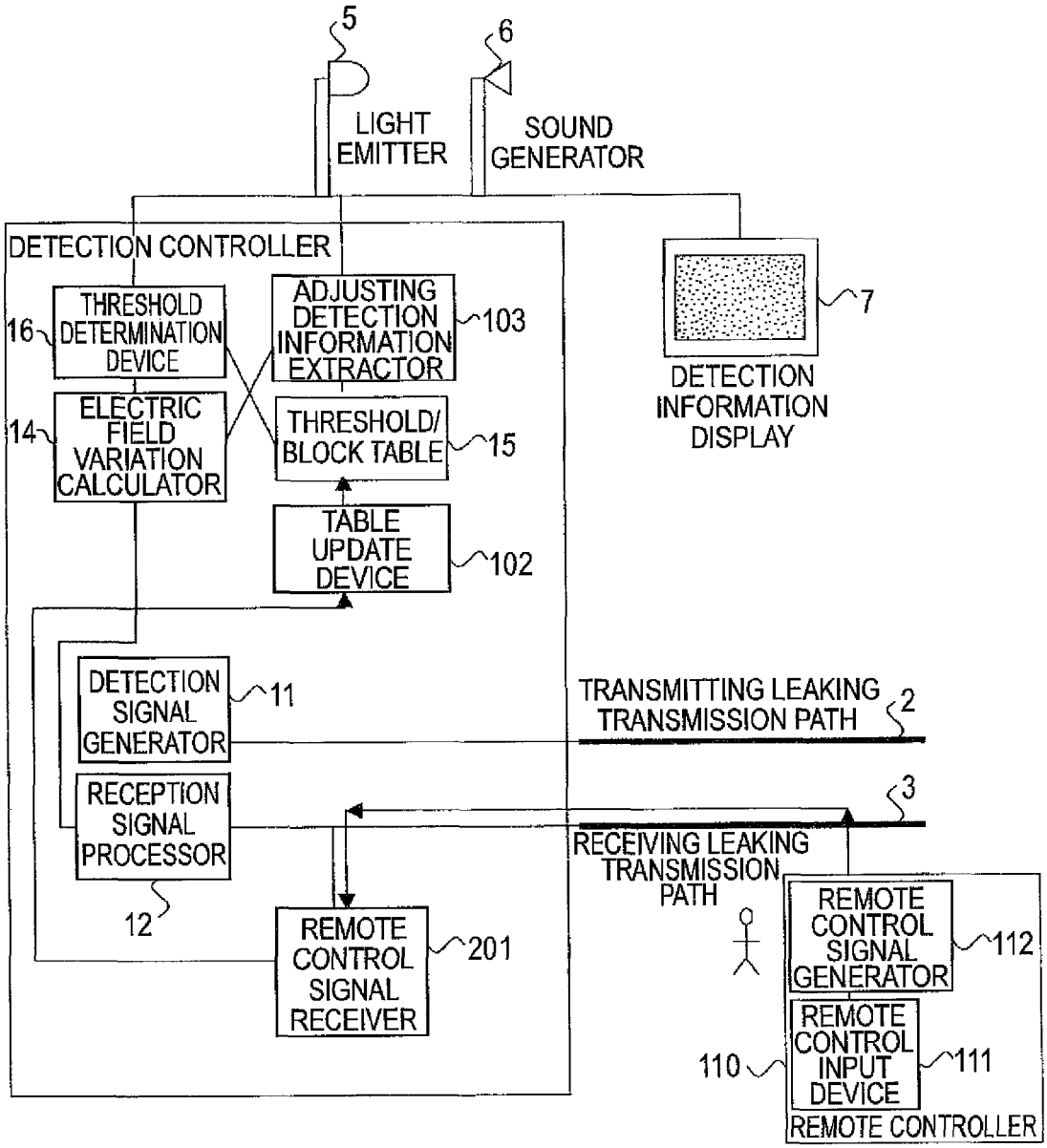
FIG. 19 is a diagram showing another example of a system configuration of an intrusion detection system according to Embodiment 2 of the present invention.

FIG. 19 shows an example of a system configuration of an intrusion detection system according to Embodiment 2.

According to Embodiment 2, in the transmission means of the remote control information shown in Embodiment 1, a signal is used, which does not affect the detection signal; for example, a signal that has a different frequency band from that of the detection signal, or, a signal which has been subjected to code spreading with PN codes that are orthogonal to the detection signal in the same frequency band as that of the detection signal.

Figure 20:
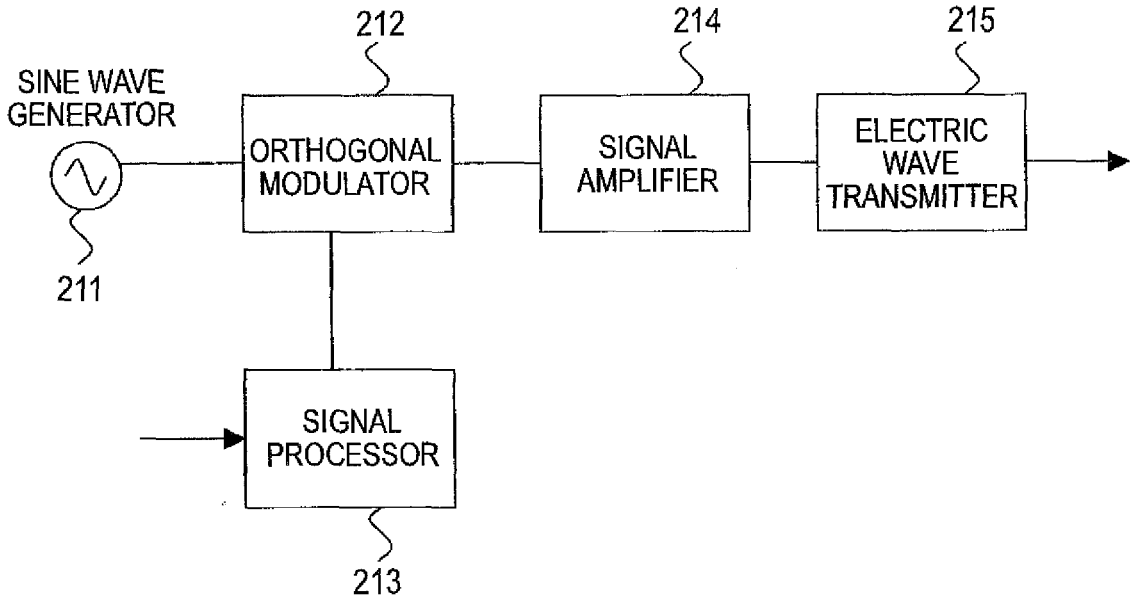
FIG. 20 is a block diagram showing Example 1 of a detailed configuration of a remote control signal generator in the intrusion detection system of FIG. 19 in a case where a signal with a different frequency band from that of a detection signal is used for a remote control signal according to Embodiment 2 of the present invention.

FIG. 20 is a block diagram showing an example of a detailed configuration of the remote control signal generator 112 in the intrusion detection system of FIG. 19 in the case where a signal with a different frequency band from that of a detection signal is used for a remote control signal.

A sine wave signal at a frequency with a different frequency band from that of the detection signal is generated by a sine wave generator 211.

A signal processor 213 calculates an in-phase component and an orthogonal component depending on digital data that is to be transmitted to the detection controller 1.

The sine wave signal generated by the sine wave generator 211 is entered into an orthogonal modulator 212.

The orthogonal modulator 212 generates a signal obtained by combining the result of multiplying by an in-phase component the entered sine wave (for example, $\cos(\omega t)$) and the result of multiplying by an orthogonal component a signal including the entered sine wave which phase has been delayed by $\pi/2$ (for example, $\sin(\omega t)$). This generates a remote control signal for transmission, in which the phase of the sine wave has been changed depending on the digital data that is to be transmitted to the detection controller 1.

The remote control signal for transmission generated by the orthogonal modulator 212 is amplified by a signal amplifier 214, and the amplified remote control signal for transmission is transmitted by an electric wave transmitter 215 to the receiving leaking transmission path 3 as an electric wave.

Figure 21:
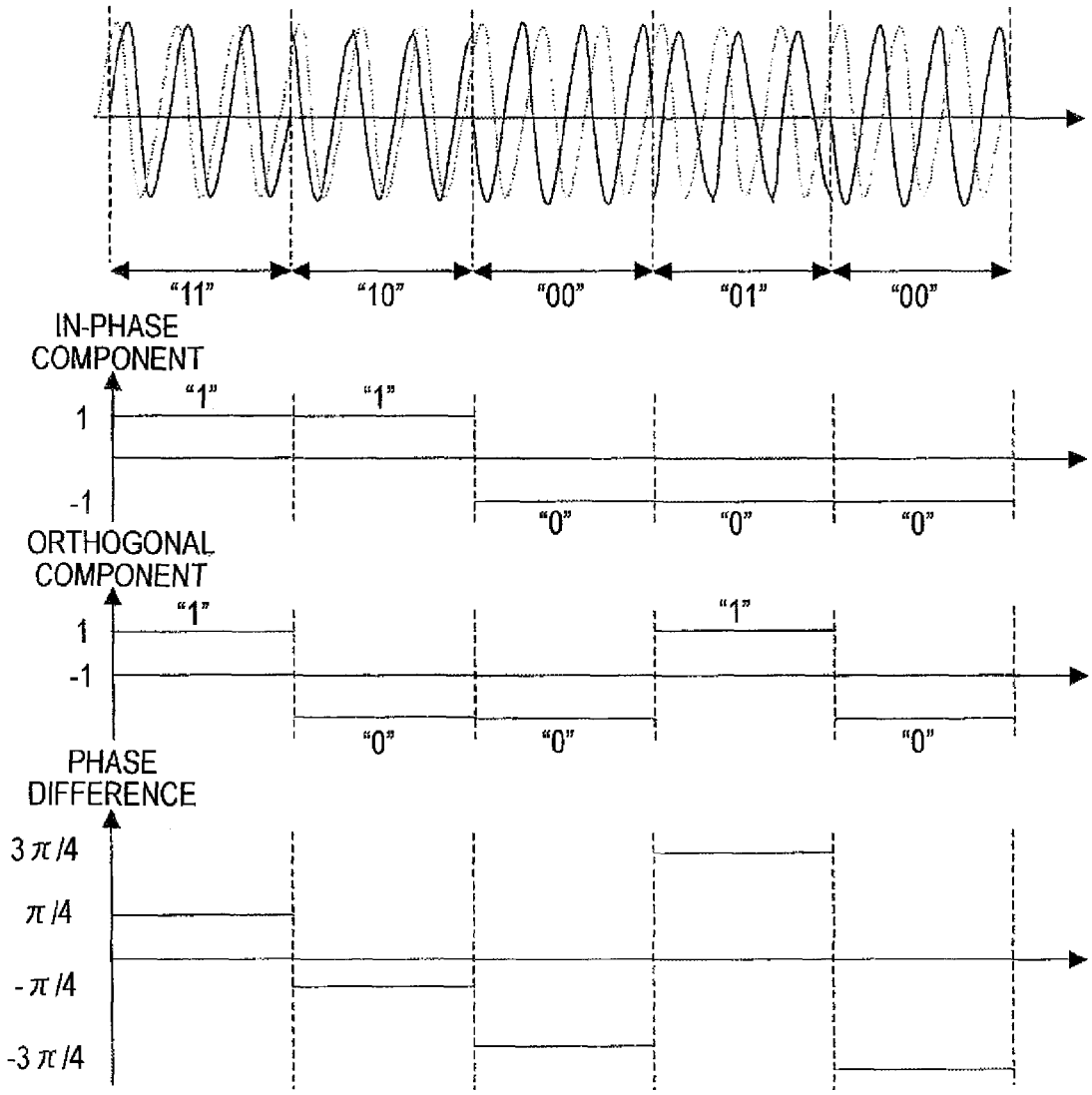
FIG. 21 is a diagram showing an example of a signal waveform of a threshold adjustment dedicated signal that is a remote control signal transmitted by an electric wave transmitter in Example 1 of a detailed configuration of the remote control signal generator of FIG. 20 according to Embodiment 2 of the present invention.

FIG. 21 shows an example of the remote control signal transmitted by the electric wave transmitter 215 of FIG. 20.

FIG. 21 shows an example of a signal modulated with QPSK (Quadrature Phase Shift Keying). As shown, in QPSK, 2-bit digital data are transmitted over four phases each separated by $\pi/2$.

Figure 22:
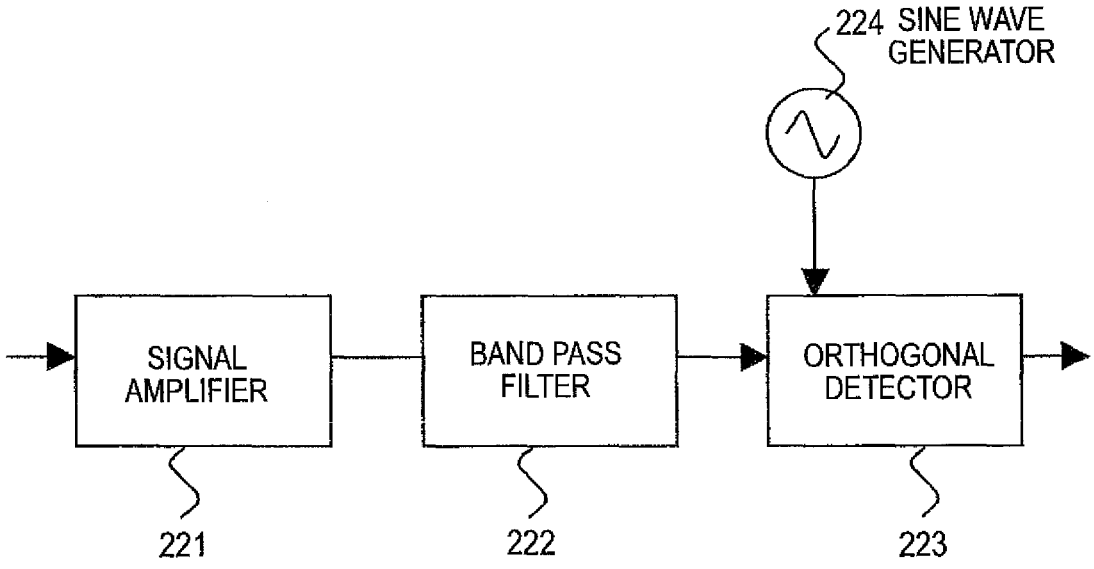
FIG. 22 is a block diagram showing Example 1 of a detailed configuration of a remote control signal receiver in the intrusion detection system of FIG. 19 in a case where a signal having a different frequency band from that of a detection signal is used for a remote control signal according to Embodiment 2 of the present invention.

FIG. 22 is a block diagram showing an example of a detailed configuration of the remote control signal receiver 201 in the intrusion detection system of FIG. 19 in a case where a signal with a different frequency band from that of a detection signal is used for a remote control signal.

The received signal is amplified by a signal amplifier 221, and entered into a band pass filter 222. The detection signals and the noise components that are outside of the band of the remote control signal are removed by the band pass filter 222.

A sine wave signal with the same frequency band as that of the sine wave generator 211 of FIG. 20 is generated by a sine wave generator 224.

The received signal passing through the band pass filter 222 and the sine wave signal generated by the sine wave generator 224 are entered into an orthogonal detector 223, the in-phase component and the orthogonal component are extracted by the orthogonal detector 223 and digital data transmitted from the remote controller is decoded.

Figure 23:
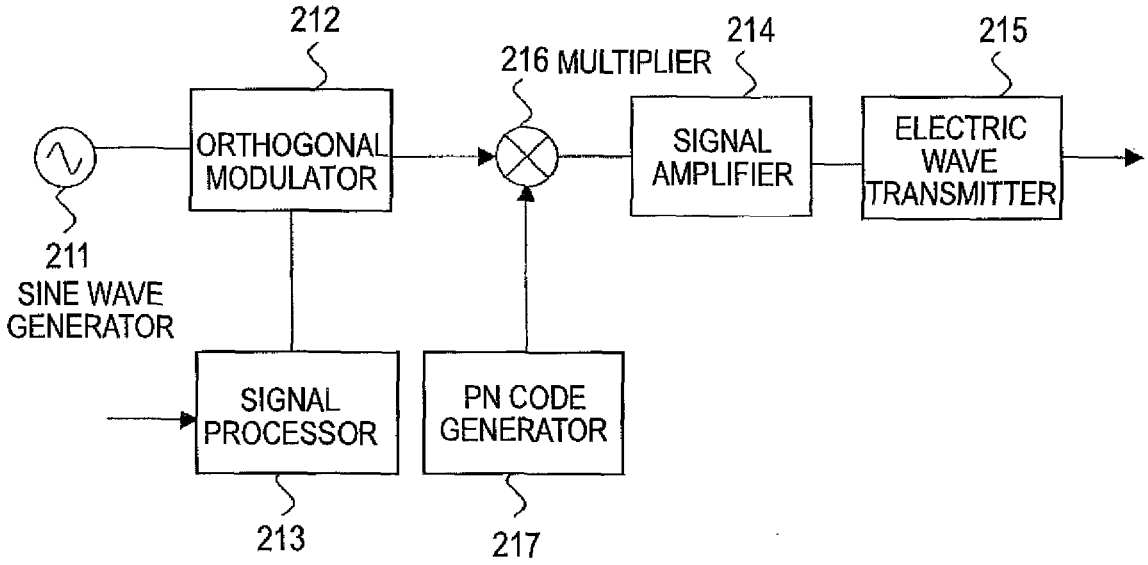
FIG. 23 is a block diagram showing Example 2 of a detailed configuration of a remote control signal generator in the intrusion detection system of FIG. 19 in a case where a signal that has been spectrum-spread with PN codes orthogonal to a detection signal in the same frequency band as that of a detection signal is used for a remote control signal according to Embodiment 2 of the present invention.

FIG. 23 is a block diagram showing an example of a detailed configuration of a remote control signal generator 112 in the intrusion detection system of FIG. 19 in the case where a signal that has been spectrum-spread with PN codes orthogonal to a detection signal in the same frequency band as that of a detection signal is used for a remote control signal.

A sine wave signal with the same frequency band as that of the detection signal is generated by the sine wave generator 211.

The signal processor 213 calculates an in-phase component and an orthogonal component depending on digital data that is to be transmitted to the detection controller 1.

The sine wave signal generated by the sine wave generator 211 is entered into the orthogonal modulator 212. The orthogonal modulator 212 generates a signal obtained by combining the result of multiplying by an in-phase component the entered sine wave (for example, $\cos(\omega t)$) and the result of multiplying by an orthogonal component a signal including the entered sine wave which phase has been delayed by $\pi/2$ (for example, $\sin(\omega t)$). This generates a signal, in which the phase of the sine wave has been changed depending on the digital data that is to be transmitted to the detection controller 1.

A PN code generator 217 generates PN codes that are orthogonal to (have a small cross-correlation with) the PN codes used for the detection signal.

A signal generated by the orthogonal modulator 212 is multiplied in a multiplier 216 with the PN codes generated by the PN code generator 217 and becomes spectrum-spread. The remote control signal for transmission that has been spectrum-spread is amplified by the signal amplifier 214, and the amplified remote control signal for transmission is transmitted by the electric wave transmitter 215 to the receiving leaking transmission path 3 as an electric wave.

Figure 24:
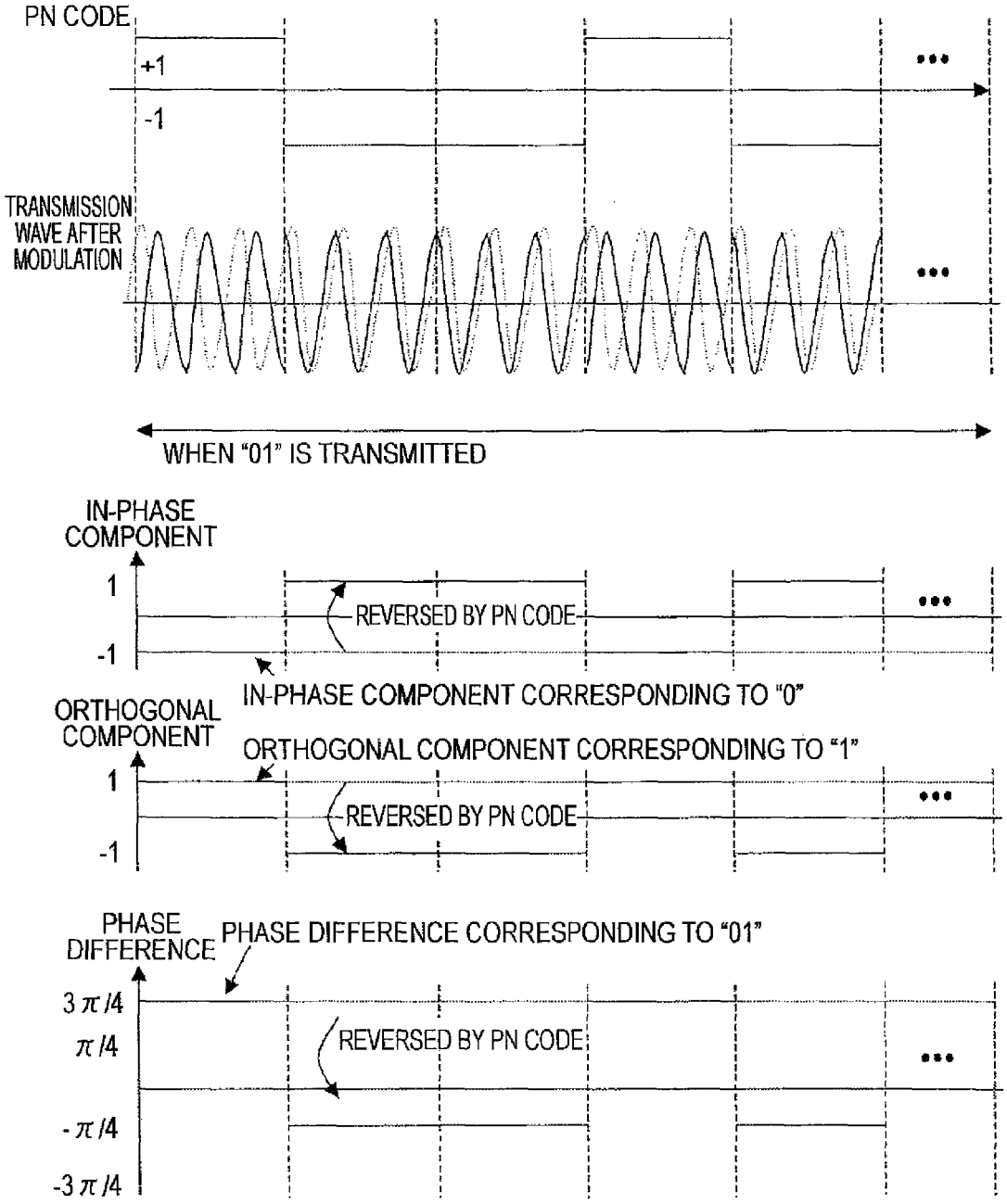
FIG. 24 is a diagram showing an example of a signal waveform of a threshold adjustment dedicated signal that is a remote control signal transmitted by the electric wave transmitter in Example 2 of a detailed configuration of the remote control signal generator of FIG. 23 according to Embodiment 2 of the present invention.

FIG. 24 shows an example of the remote control signal transmitted by the electric wave transmitter 215 of FIG. 23.

FIG. 24 shows an example of a signal obtained by spectrum-spreading with PN codes a signal modulated with QPSK (Quadrature Phase Shift Keying). As shown, in QPSK, since 2-bit digital data are transmitted over four phases each separated by $\pi/2$, the signal shown in FIG. 24 has the phases corresponding to the 2-bit digital data that are transmitted, a portion of the phases being reversed by the PN codes.

Figure 25:
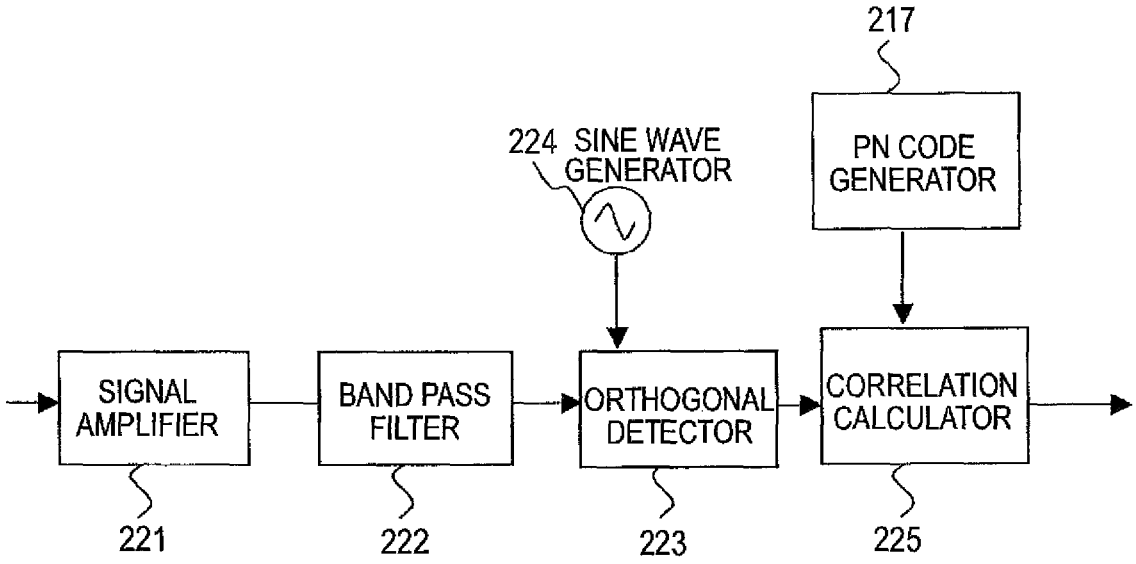
FIG. 25 is a block diagram showing Example 2 of a detailed configuration of a remote control signal receiver in the intrusion detection system of FIG. 19 in a case where a signal that has been spectrum-spread with PN codes orthogonal to a detection signal in the same frequency band as that of a detection signal is used for a remote control signal according to Embodiment 2 of the present invention.

FIG. 25 is a block diagram showing an example of a detailed configuration of the remote control signal receiver 201 in the intrusion detection system of FIG. 19 in a case where a signal that has been spectrum-spread with PN codes orthogonal to a detection signal in the same frequency band as that of a detection signal is used for a remote control signal.

The received signal is amplified by a signal amplifier 221, and entered into the band pass filter 222. The noise components that are outside of the band of the remote control signal are removed by the band pass filter 222.

A sine wave signal with the same frequency band as that of the sine wave generator 211 of FIG. 20 is generated by the sine wave generator 224.

The received signal and the sine wave signal generated by the sine wave generator 224 are entered into an orthogonal detector 223, and the in-phase component and the orthogonal component are extracted by the orthogonal detector 223.

The same PN code as that of the PN code generator 217 of FIG. 23 is generated by a PN code generator 225.

The correlation calculation of the PN code generated by the PN code generator 217 and the in-phase component and the orthogonal component extracted by the orthogonal detector 223 is performed by a correlation calculator 225, thus the in-phase components and the orthogonal components prior to spectrum spreading are decoded (de-spread) to demodulate the transmitted digital data. At that time, since the detection signal contained in the received signal is orthogonal to (has a small cross-correlation with) the PN codes generated by the PN code generator 217, the detection signal is removed.

The digital data transmission method for transmitting information for threshold setting and block setting from the remote controller 110 to the detection controller 1 in FIG. 19 uses PSK (Phase Shift Keying), QAM (Quadrature Amplitude Modulation) or ASK (Amplitude Shift Keying). This allows high-speed information transmission. In addition, when signals with the same frequency band are used, the configuration of the apparatus can be simplified by having a configuration in which the receiver is shared also for detection-signals.

Embodiment 3

Embodiment 3 will now be described with reference to FIGS. 26 and 27.

Figure 26:
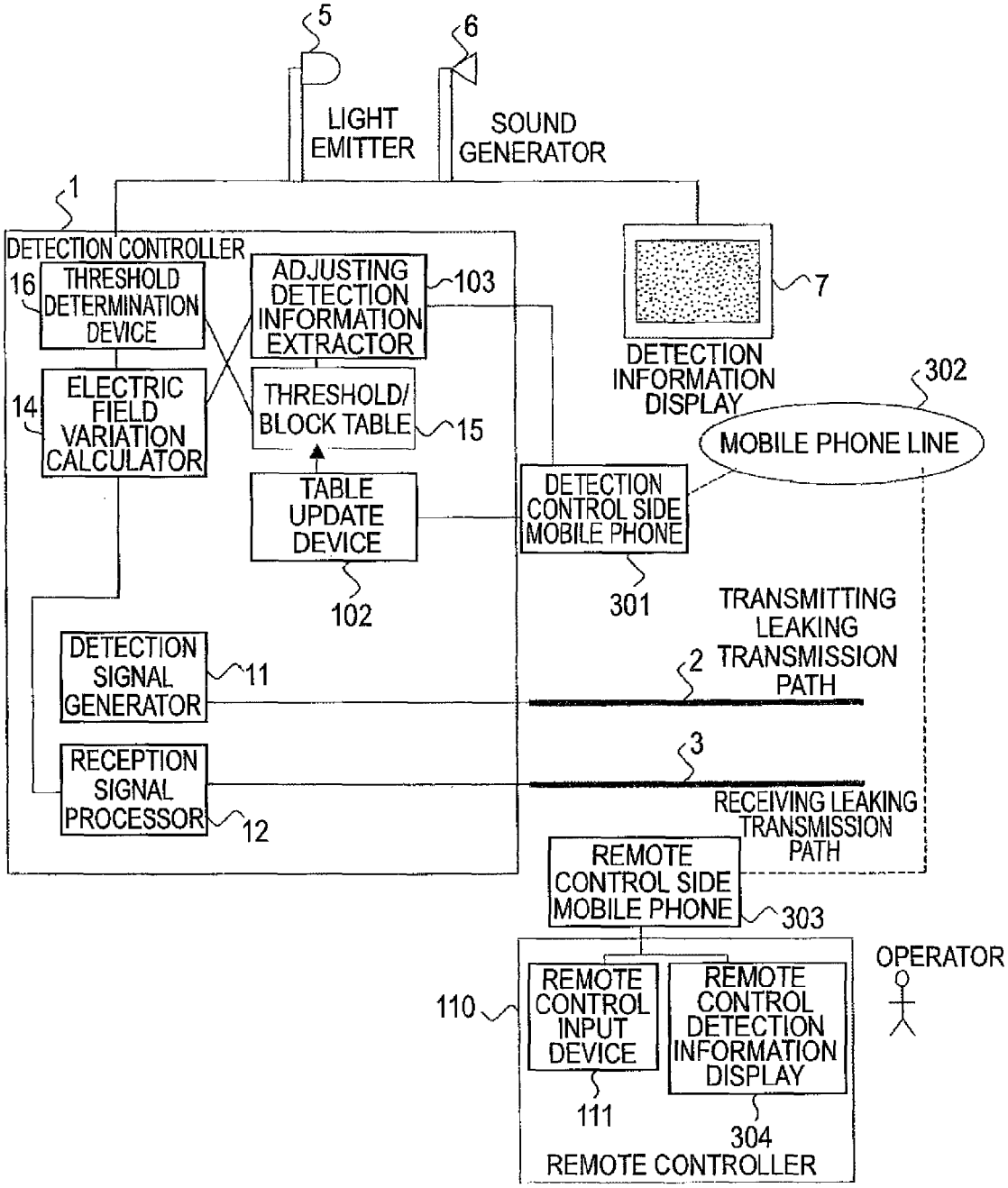
FIG. 26 is a diagram showing yet another example of a system configuration of an intrusion detection system according to Embodiment 3 of the present invention.
Figure 27:
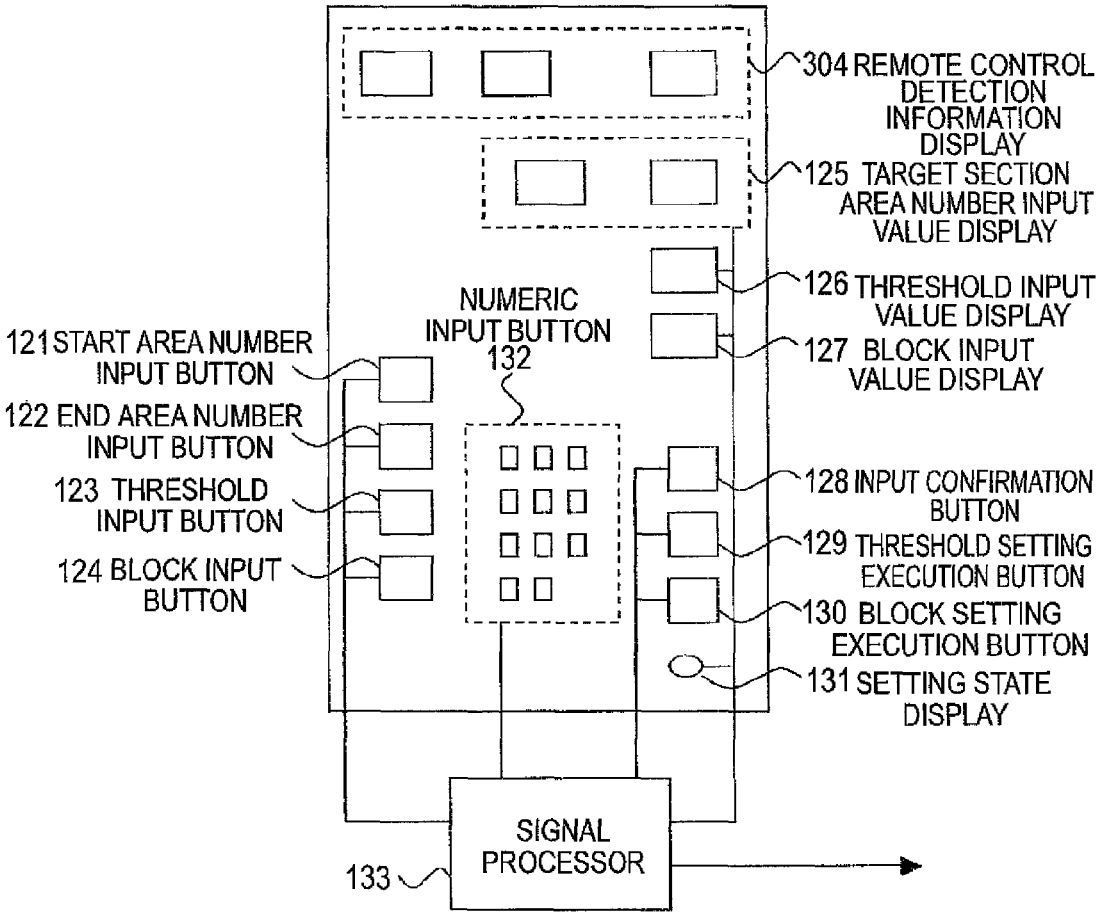
FIG. 27 is a diagram showing an example of a detailed configuration of a remote control input device in the intrusion detection system of FIG. 26 according to Embodiment 3 of the present invention.

FIG. 26 shows an example of a system configuration of an intrusion detection system according to Embodiment 3, and FIG. 27 shows an example of a detailed configuration of a remote control input device in the intrusion detection system of FIG. 26.

According to Embodiment 3, a detection control side mobile phone 301 and a remote control side mobile phone 303 are used, and an existing mobile phone line 302 is used for the communication of the remote controller 110 and the detection controller 1 in the system configuration of Embodiment 1.

According to Embodiment 3, the information transmission from the detection controller 1 to the remote controller 110 is possible. The area number where the amount of variation in the electric field increases at the time of intrusion and the block number therefor, and the value of the amount of variation in the electric field at that time are transmitted to the remote controller 110 by the detection controller 1. A remote control detection information display 304 is provided in the remote controller 110, and information transmitted from the detection controller is displayed on the remote control detection information display 304 so as to be informed to the setting operator.

Specifically, the detection control side mobile phone 301 is connected with the detection controller 1 through a data communication cable such as a USB. In addition, the remote control side mobile phone 303 is connected with the remote controller 110 through a data communication cable such as a USB.

Before the threshold adjustment task and the block adjustment task, the operator uses the remote control side mobile phone 303 to make a call to the detection control side mobile phone 301. When the detection control side mobile phone 301 automatically receives the incoming call, the call is established.

Information transmission from the remote controller 110 to the detection controller 1 and information transmission from the detection controller 1 to the remote controller 110 are achieved by data transmission through the mobile phone line.

The area number where the amount of variation in the electric field increases at the time of intrusion and the block number therefor, and the value of the amount of variation in the electric field at that time are extracted by the adjusting detection information extractor 103 and transmitted to the detection control side mobile phone 301 through the data transmission cable.

The transmitted information is transmitted to the remote control side mobile phone 303 through the mobile phone line 302.

The remote control detection information display 304 receives the information transmitted to the remote control side mobile phone 303 through the data transmission cable, and displays the area number where the amount of variation in the electric field increases at the time of intrusion and the block number therefor, and the value of the amount of variation in the electric field at that time.

The information entered into the remote control input device 111 and the method thereof are the same as those of Embodiment 1, and the information entered into the remote control input device 111 is transmitted to the remote control side mobile phone 303 through the data transmission cable. The transmitted information is transmitted to the detection control side mobile phone 301 through the mobile phone line 302.

A table update device 102 receives the information transmitted to the detection control side mobile phone 301 through the data transmission cable, and updates the threshold/block table based on the transmitted information.

If it is a mobile phone coverage, two-way information transmission means between the detection controller 1 and the remote controller 110 can be obtained readily. In addition, since the information is displayed on the remote control detection information display 304, the operator can properly discern the information from the detection controller 1 compared with the transmission to the operator via a sound in Embodiments 1 and 2.

Embodiment 4

Figure 28:
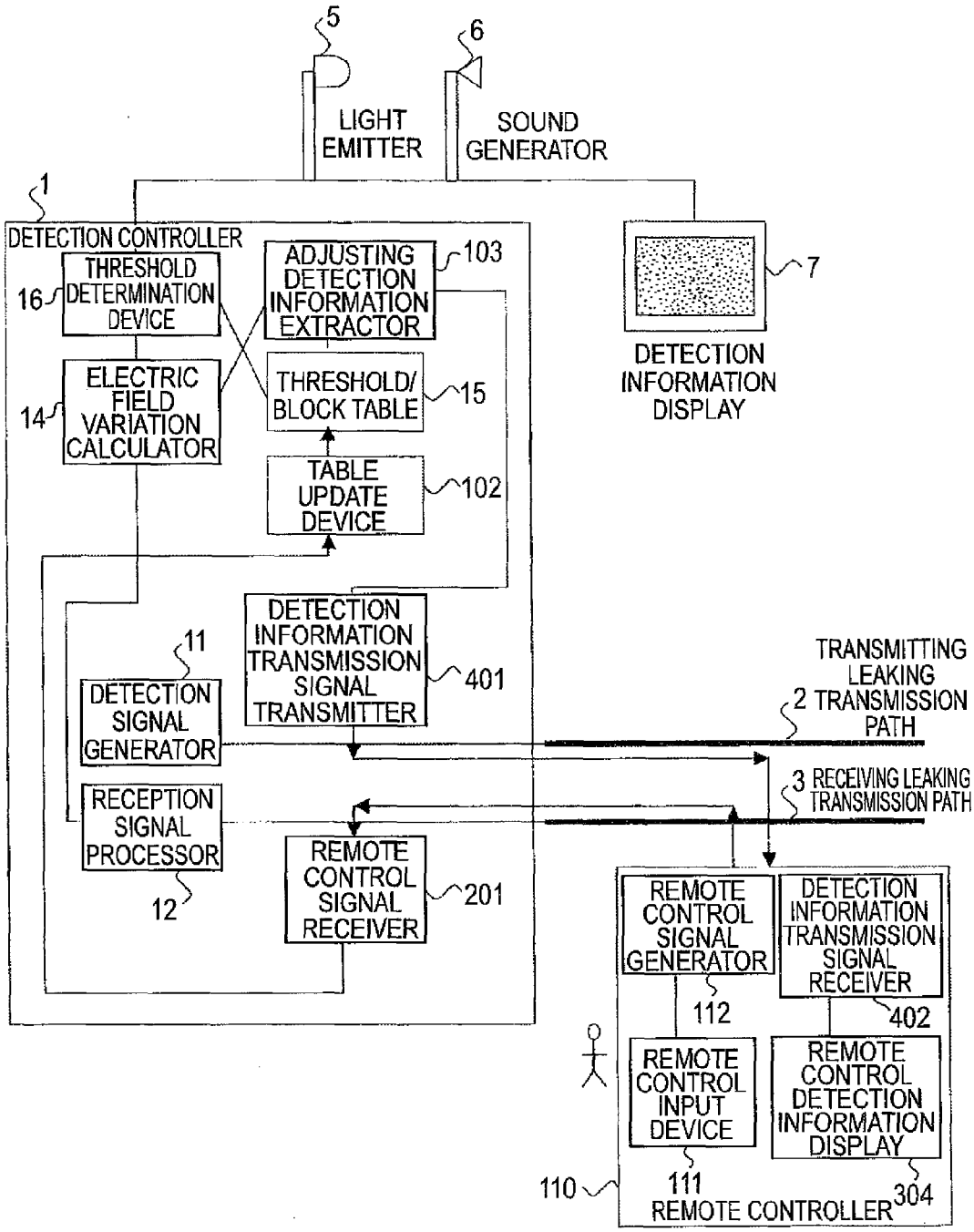
FIG. 28 is a diagram showing yet another example of a system configuration of an intrusion detection system according to Embodiment 4 of the present invention.

Embodiment 4 will now be described with reference to FIG. 28 showing an example of a system configuration of an intrusion detection system according to Embodiment 4.

According to Embodiment 4, a detection information transmission signal transmitter 401 is provided on the detection controller 1 and a detection information transmission signal receiver 402 is provided on the remote controller 110 so that information can be transmitted from the detection controller 1 to the remote controller 110 in the system configuration of Embodiment 2.

Specifically, the detection information transmission signal from the detection controller 1 for transmitting the area number where the amount of variation in the electric field increases at the time of intrusion and the block number therefor, and the value of the amount of variation in the electric field at that time is superposed by the detection information transmission signal transmitter 401 onto the detection signal and applied to the transmitting leaking transmission path 2.

The detection information transmission signal is transmitted to the remote controller 110 through the transmitting leaking transmission path 2.

The remote controller 110 includes the detection information transmission signal receiver 402 so as to receive the detection information transmission signal.

The transmitted detection information is displayed on the remote control detection information display 304 of the remote controller 110 so as to be informed to the setting operator.

The detailed configuration of the remote control input device 111 and the remote control detection information display 304 are the same as that of Embodiment 3. The method for transmitting information from the detection controller 1 to the remote controller 110 is the same as that of Embodiment 2.

Two-way communication becomes possible with no mobile phone line, thus allowing inexpensive and high-confidential communication.

Embodiment 5

Figure 29:
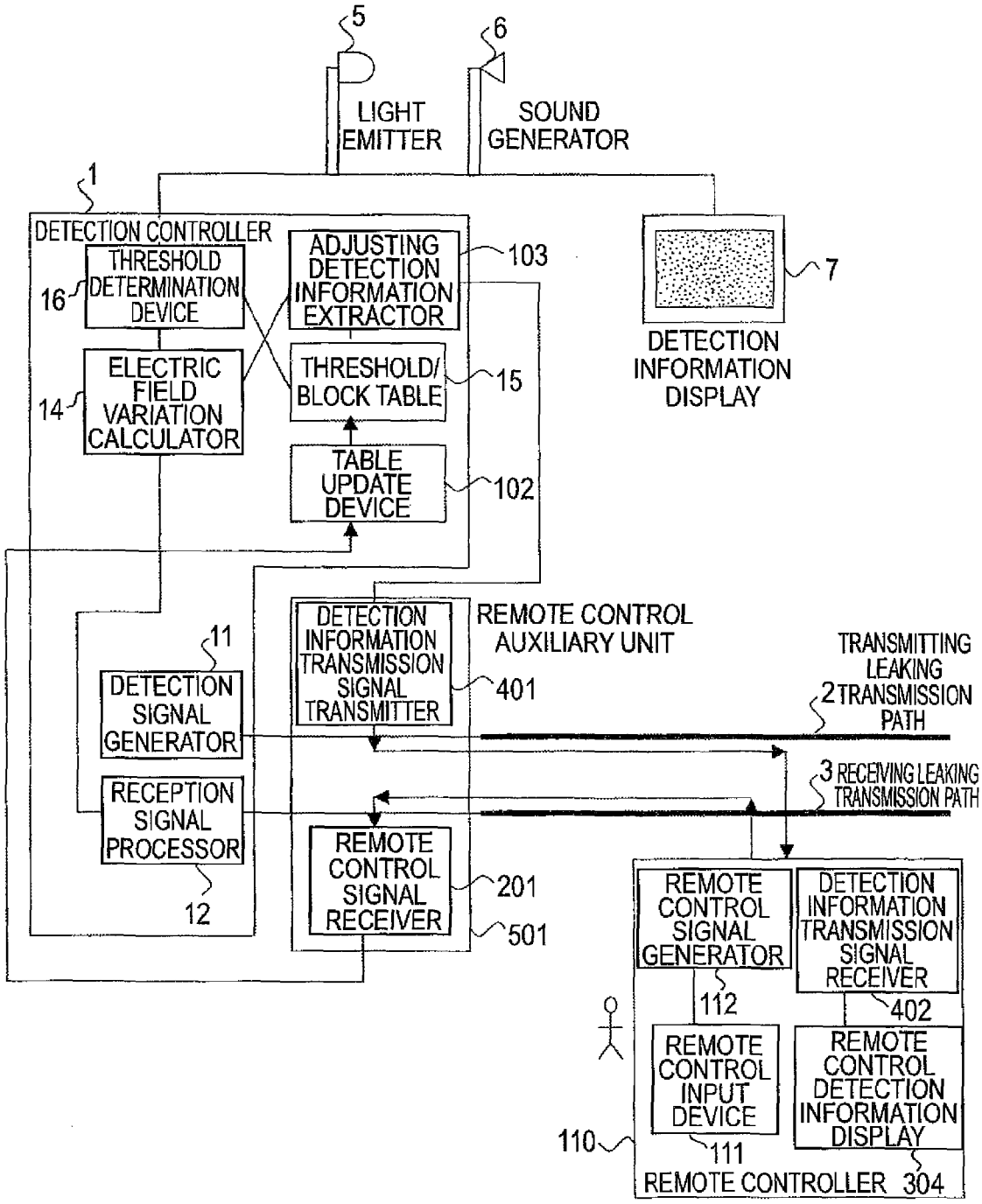
FIG. 29 is a diagram showing yet another example of a system configuration of an intrusion detection system according to Embodiment 5 of the present invention.

Embodiment 5 will now be described with reference to FIG. 29 showing an example of a system configuration of an intrusion detection system according to Embodiment 5.

According to Embodiment 5, the remote control signal receiver 201 and the detection information transmission signal transmitter 401 in the system configuration of Embodiment 4 are external parts that can be mounted on the detection controller 1 as a remote control auxiliary unit 501.

Thus, a remote control function can be added without changing existing devices.

In addition, the reception signal intensity detector 13 and the remote control signal detector 101 of Embodiment 1 may be external parts. Further, the remote control signal receiver 201 of Embodiment 2 may be an external part.

Embodiment 6

Figure 30:
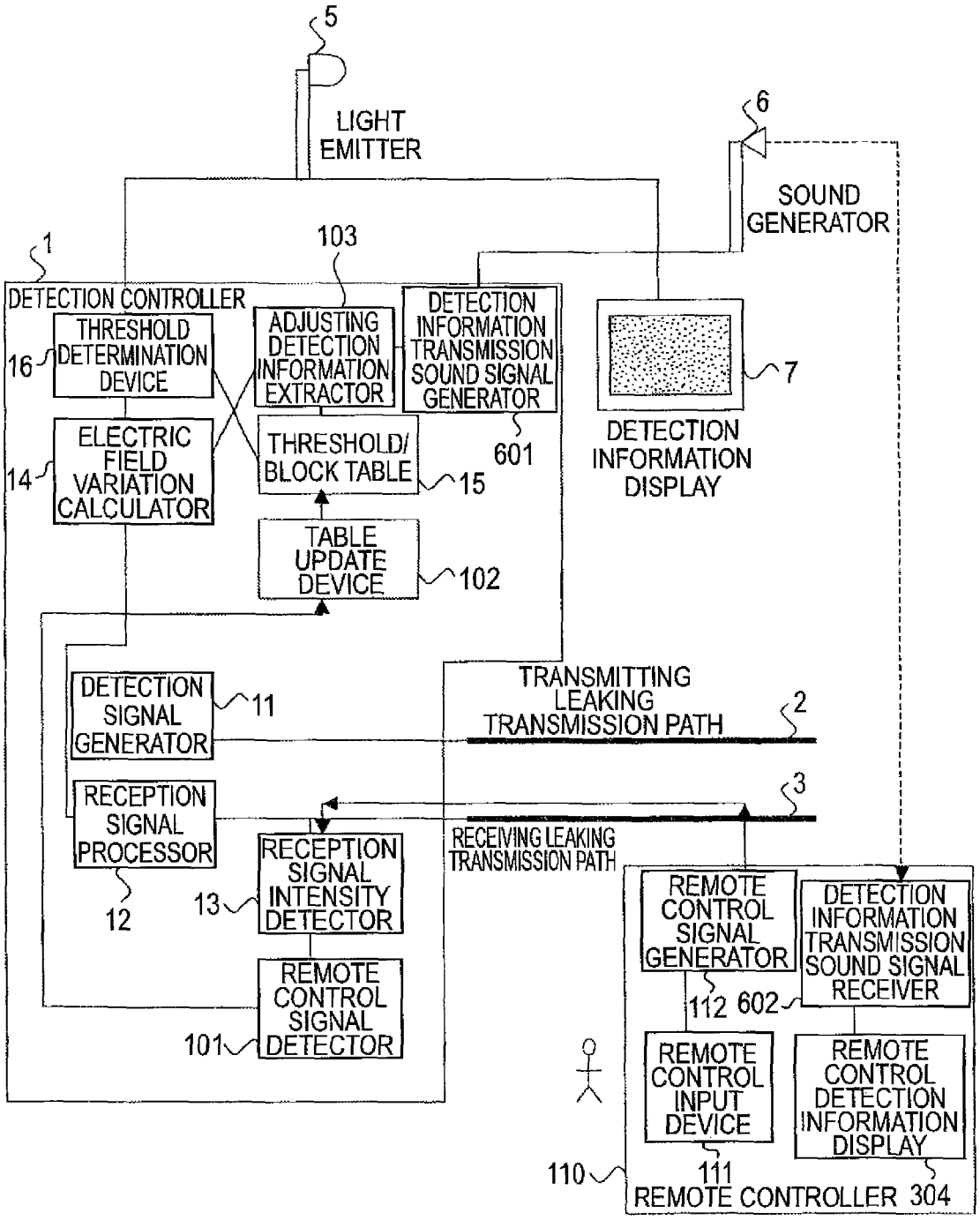
FIG. 30 is a diagram showing yet another example of a system configuration of an intrusion detection system according to Embodiment 6 of the present invention.

Embodiment 6 will now be described with reference to FIG. 30 showing an example of a system configuration of an intrusion detection system according to Embodiment 6.

According to Embodiment 6, a communication by a sound in the audible region or an ultrasound is used for the information transmission means from the detection controller 1 to the remote controller 110 in the system of Embodiment 4.

A detection information transmission sound signal is generated by a detection information transmission sound signal generator 601 provided in the detection controller 1, and output by the sound generator 6 connected to the detection controller 1.

The signal to be output may be a sound in the audible region or an ultrasound having a higher frequency than the audible region. In addition, a signal in which the frequency, amplitude or phase changes with a specific pattern depending on the digital data to be transmitted is used for the output signal.

A detection information transmission sound signal receiver 602 extracts the specific pattern from the sound signal that is to be received, and demodulates the transmitted digital data. In addition, the signal to be output may be achieved as an audible sound to humans, and the detection information transmission sound signal receiver 602 may be achieved as recognizing the sound.

Thus, the information transmission means from the detection controller 1 to the remote controller 110 can be obtained with no additional device.

Embodiment 7

Embodiment 7 will now be described with reference to FIGS. 31 to 35.

Figure 31:
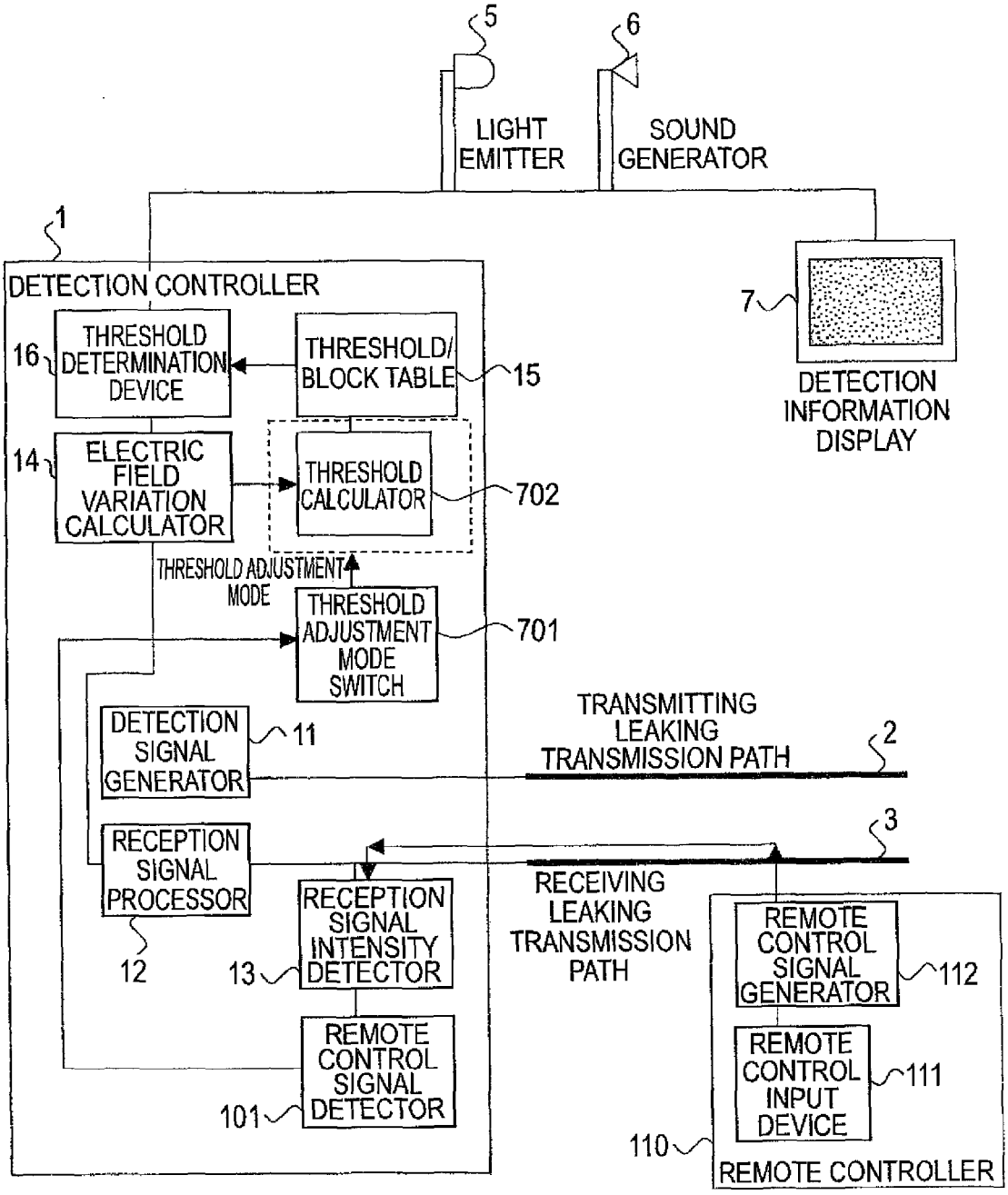
FIG. 31 is a diagram showing yet another example of a system configuration of an intrusion detection system according to Embodiment 7 of the present invention.
Figure 32:
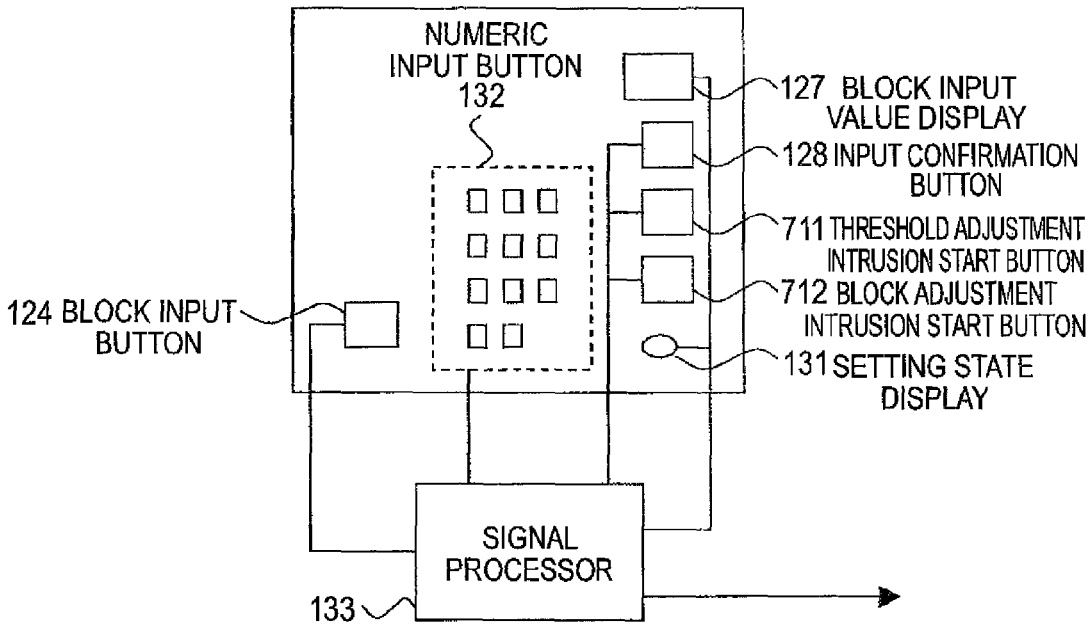
FIG. 32 is a diagram showing an example of a detailed configuration of a remote control input device in the intrusion detection system of FIG. 31 according to Embodiment 7 of the present invention.
Figure 33:
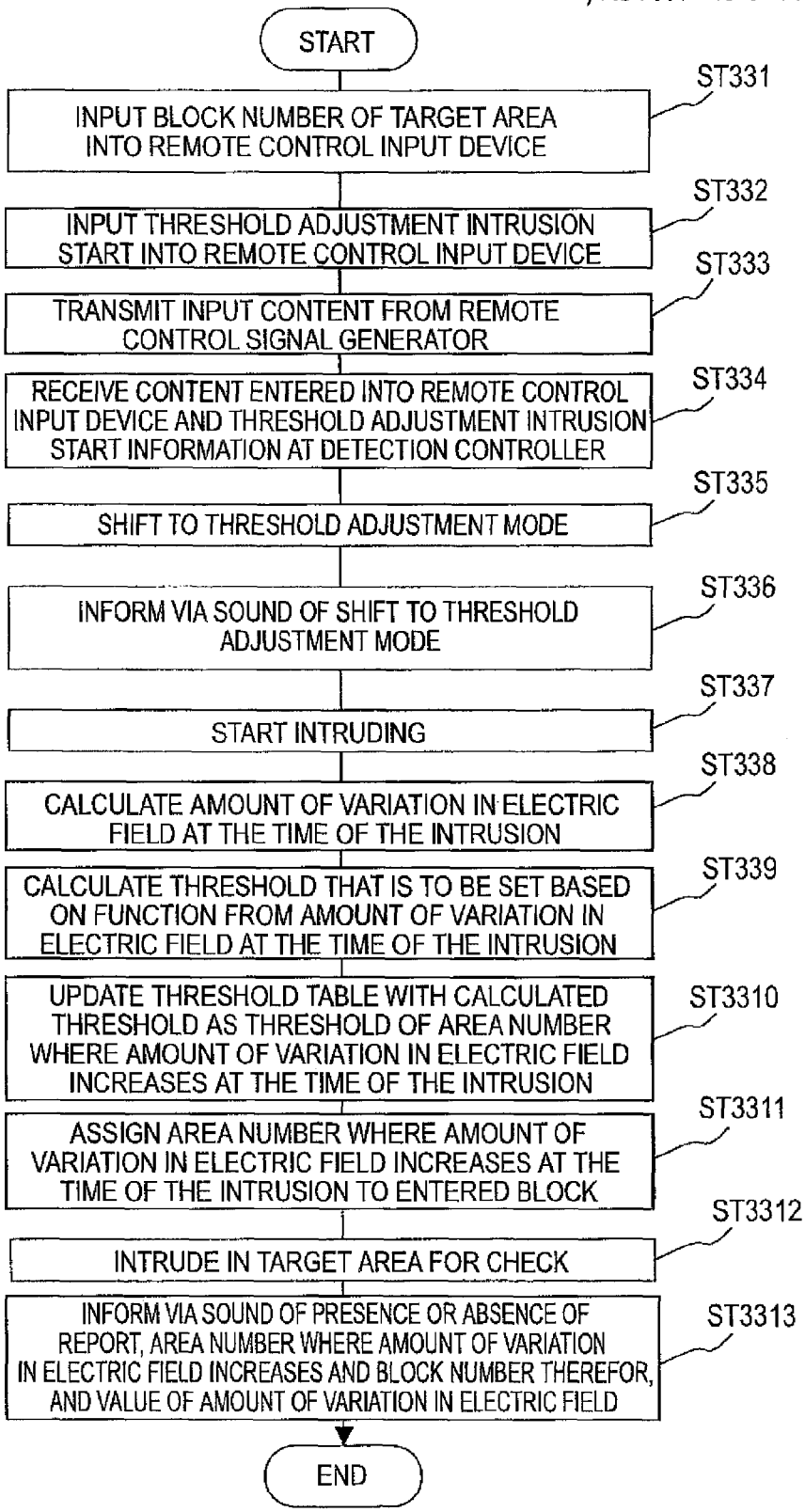
FIG. 33 is a flow chart illustrating a threshold setting adjustment procedure for each block in the intrusion detection system of FIG. 31 according to Embodiment 7 of the present invention.
Figure 34:
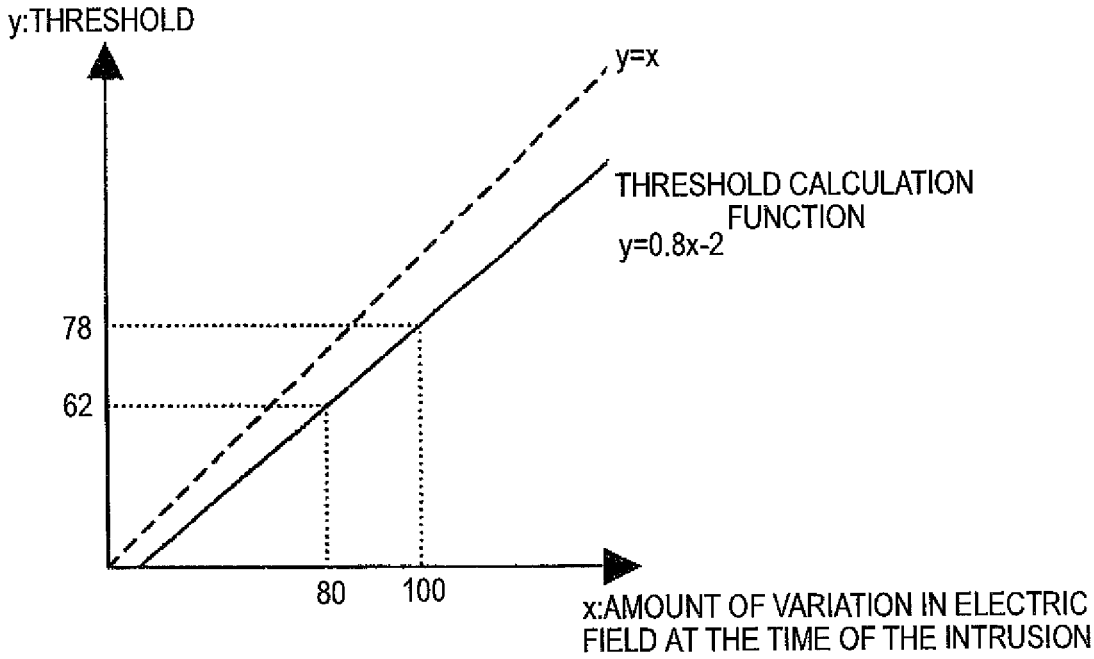
FIG. 34 is a diagram showing an example of a threshold calculation function according to Embodiment 7 of the present invention.
Figure 35:
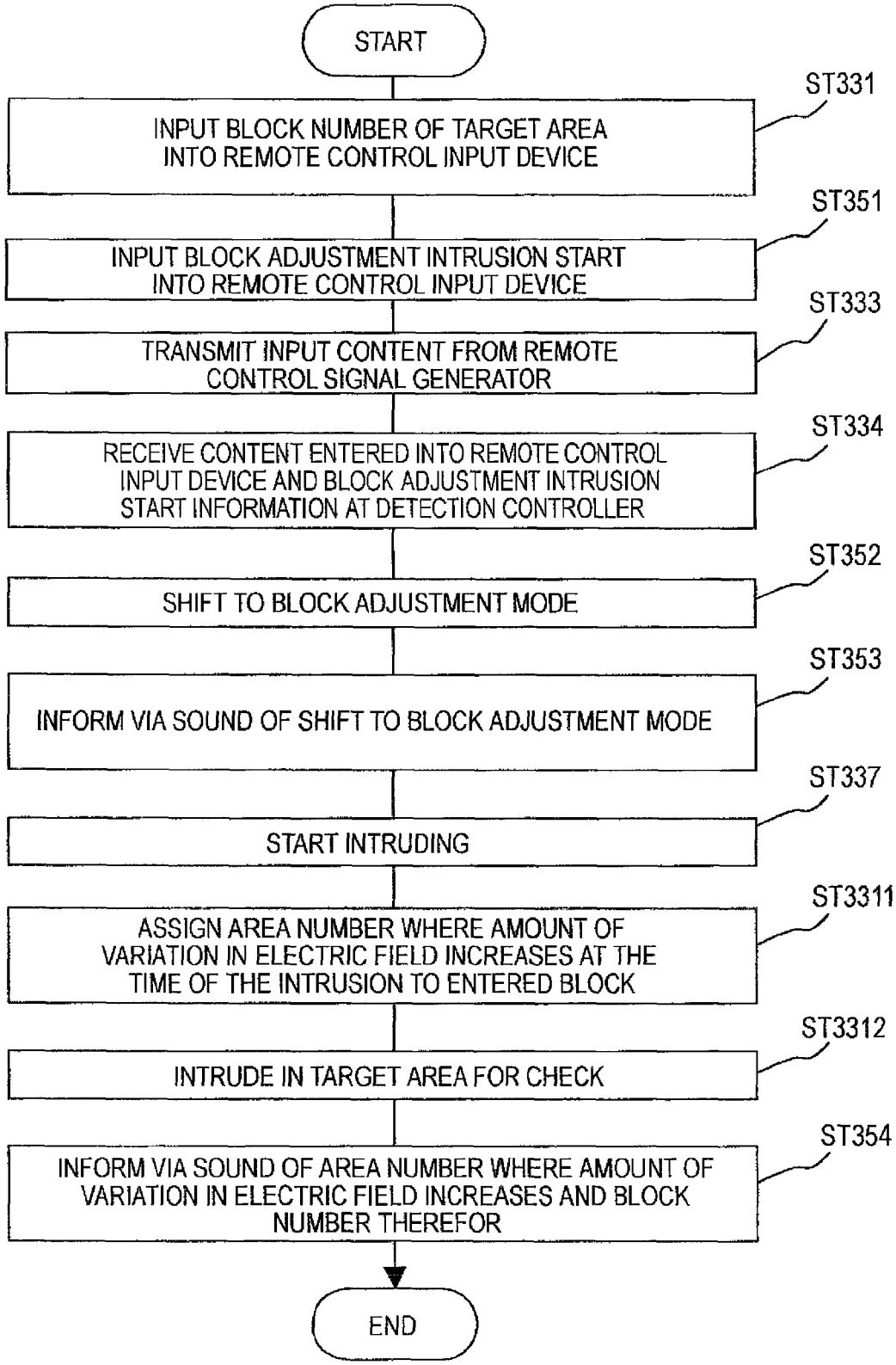
FIG. 35 is a flow chart showing another example of an adjustment procedure of a block that is a detection target section according to Embodiment 7 of the present invention.

FIG. 31 shows an example of a system configuration of an intrusion detection system of Embodiment 7, FIG. 32 shows an example of a detailed configuration of a remote control input device in the intrusion detection system of FIG. 31, FIG. 33 shows a flow chart of a threshold setting adjustment procedure for each block in the intrusion detection system of FIG. 31, FIG. 34 shows an example of a threshold calculation function and FIG. 35 shows a flow chart of another example of an adjustment procedure of a block that is a detection target section.

According to Embodiment 7, a block adjustment can be performed along with a threshold adjustment.

The setting operator inputs the block number for the target area into the remote control input device 111 (step ST331). When the block adjustment is not performed, but only the threshold adjustment is performed, a block number may not be entered.

Next, a threshold adjustment intrusion start button 711 of the remote control input device 111 is pressed (step ST332). When the threshold adjustment intrusion start button 711 is pressed, threshold adjustment intrusion start information is transmitted to the detection controller 1 by the signal transmission means of Embodiment 1 from the remote control signal generator 112 (step ST333). When the content entered into the remote control input device and the threshold adjustment intrusion start information are received by the detection controller 1, a shift to a threshold adjustment mode occurs (step ST335). The shift to the threshold adjustment mode is informed to the operator via a sound generated by the sound generator 6 (step ST336).

Next, the operator starts intruding in the target area (step ST337). The detection controller 1 watches the increase in the amount of variation in the electric field caused by the intrusion (step ST338), causes a threshold calculator 702 to automatically calculate a threshold that is to be set (step ST339), and stores the calculated threshold into the threshold/block table 15 (step ST3310). In addition, for the area number where the variation level of the electric field increases at the time of intrusion, the block number entered into the remote control input device 111 is stored in the threshold/block table 15 (step ST3311). Thereafter, the operator intrudes again (step ST3312) to check that the setting is properly performed (step ST3313).

FIG. 34 shows an example of a threshold calculation function.

By calculating a threshold by the function shown in FIG. 34 depending on the amount of variation in the electric field at the time of intrusion of the operator, a proper threshold can be calculated automatically. For example, when the amount of variation in the electric field at the time of intrusion in an area by the operator becomes 80, the threshold for the area is set to 62.

In addition, only block adjustment may be performed. FIG. 35 shows a flow chart of the procedure of the case where only block adjustment is performed.

The setting operator inputs the block number for a target area into the remote control input device 111 (step ST331).

Next, a block adjustment intrusion start button 712 of the remote control input device 111 is pressed (step ST351).

When the block adjustment intrusion start button 712 is pressed, block adjustment intrusion start information is transmitted to the detection controller 1 by the signal transmission means of Embodiment 1 from the remote control signal generator 112 (step ST333).

When the content entered into the remote control input device and the block adjustment intrusion start information are received by the detection controller 1, a shift to a block adjustment mode occurs (step ST352). The shift to the block adjustment mode is informed to the operator via a sound generated by the sound generator 6 (step ST353).

Next, the operator starts intruding into the target area (step ST337).

For the area number where the variation level of the electric field increases at the time of intrusion, the detection controller 1 stores the block number entered into the remote control input device 111 in the threshold/block table 15 (step ST3311).

Thereafter, the setting operator intrudes again (step ST3312) to check that the setting is properly performed (step ST354).

Thus, the threshold adjustment can be performed more readily than in the past.

Embodiment 8

Embodiment 8 will now be described with reference to FIGS. 36 and 37.

Figure 36:
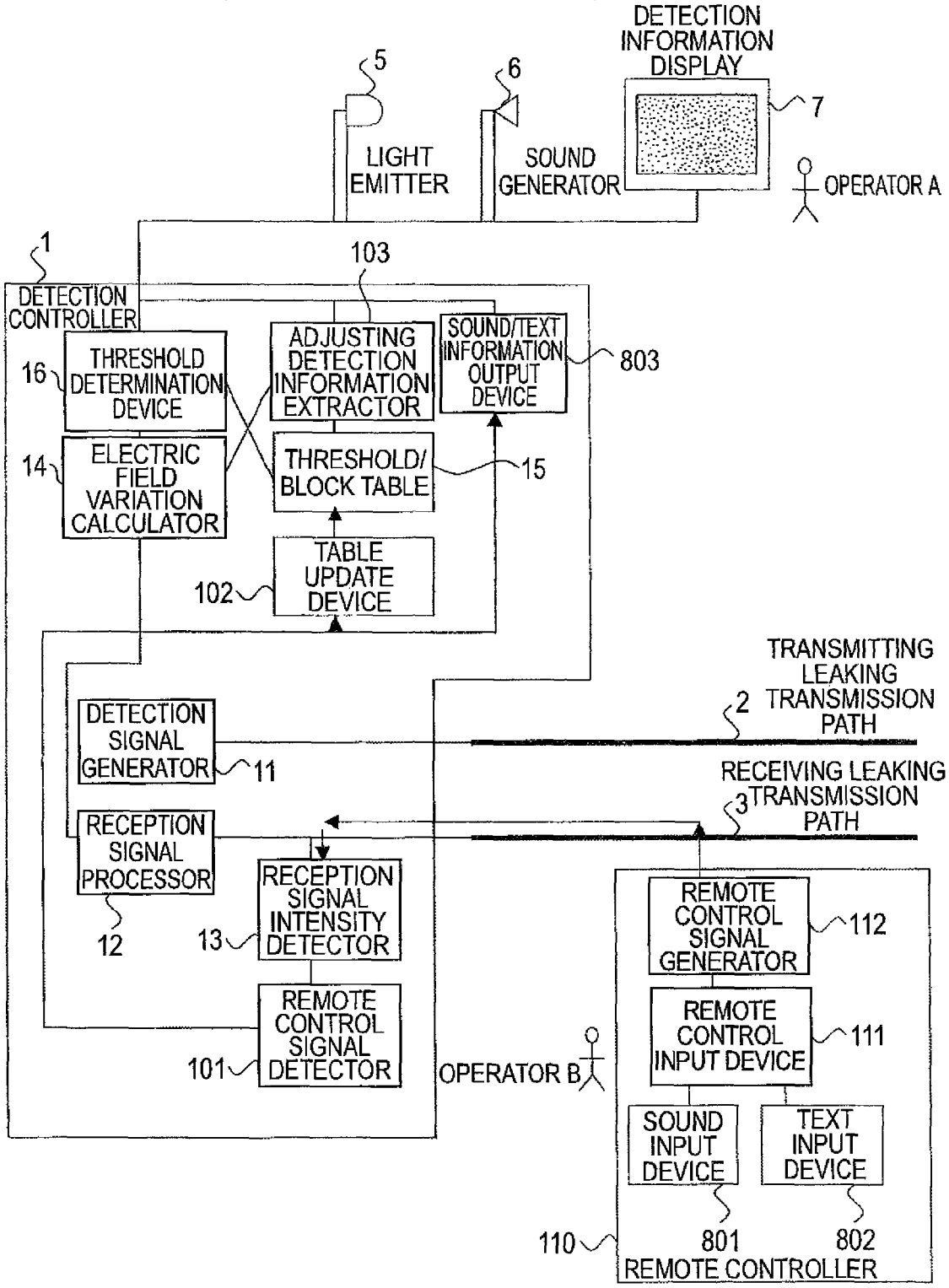
FIG. 36 is a diagram showing yet another example of a system configuration of an intrusion detection system according to Embodiment 8 of the present invention.
Figure 37:
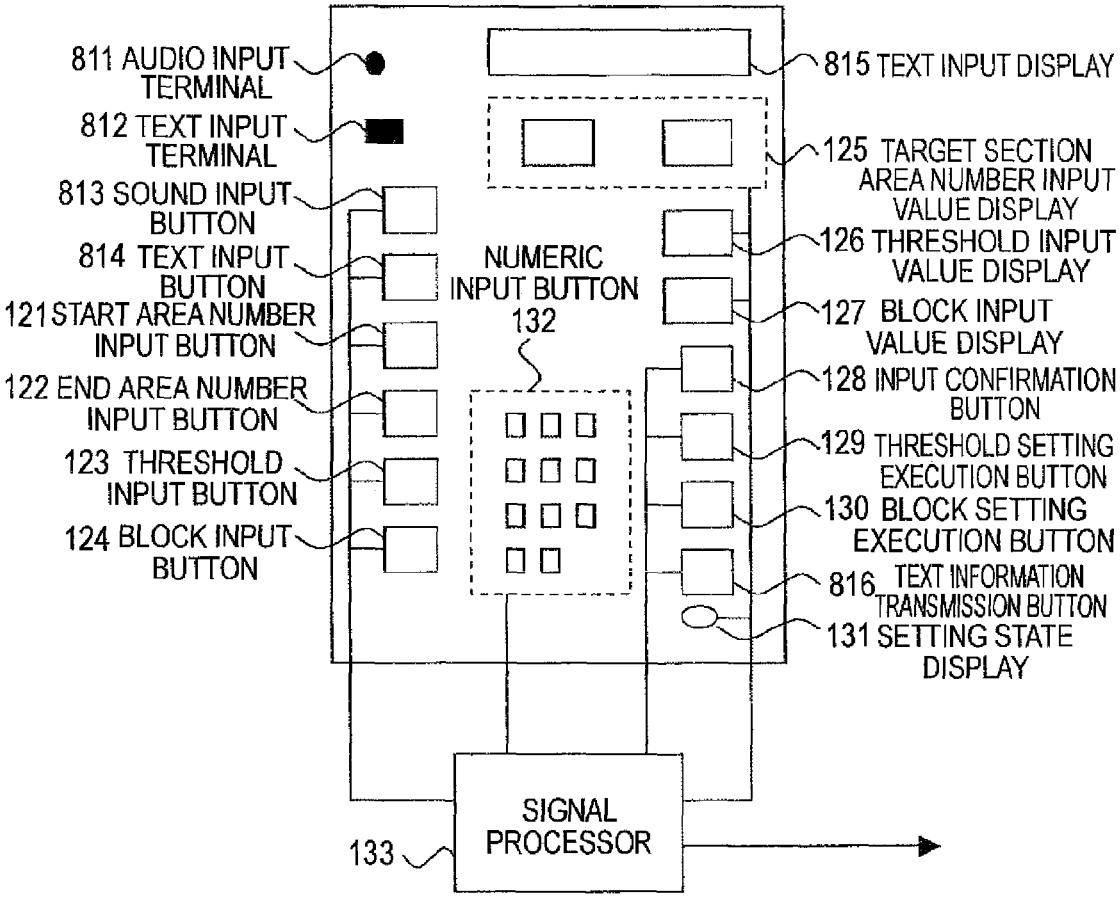
FIG. 37 is a diagram showing an example of a detailed configuration of a remote control input device in the intrusion detection system of FIG. 36 according to Embodiment 8 of the present invention.

FIG. 36 shows an example of a system configuration of an intrusion detection system according to Embodiment 8, and FIG. 37 shows an example of a detailed configuration of a remote control input device in the intrusion detection system of FIG. 36.

According to Embodiment 8, functions for connecting a sound input device 801 and a text input device 802 are added to the remote control input device 111 in the system configuration of Embodiment 1, and sound information and text information are transmitted by information transmission means according to Embodiment 1.

The sound input device such as a microphone is connected by a sound input device input terminal 811. The text input device such as a keyboard is connected by a text input device connection terminal 812. The connection to the text input device is achieved by connection means such as a USB, for example. In addition, the remote control input device 111 may include a sound input device and a text input device.

Next, the procedure of the transmission of sound information will be described.

The setting operator B inputs sound to the sound input device 801 while a sound input button 813 of the remote control input device 111 is being pressed.

When the sound input button 813 is pressed, the remote control input device 111 transmits a sound communication start signal to the detection controller 1.

In addition, while the sound input button is being pressed, the remote control input device 111 shifts to the sound communication mode, converts the entered sound signal into digital data, and continues to transmit the data to the detection controller 1.

When the sound communication start signal is received, the detection controller shifts to the sound communication mode, converts the digital data of the received sound information into a sound signal and outputs the signal by the sound generator 6.

Next, the procedure of the transmission of the text information will be described.

The setting operator B presses a text input button 814 of the remote control input device 111, and then inputs text using the text input device 802.

The entered text is displayed on a text input display 815.

The setting operator B checks the entered text and presses a text information transmission button 816.

When the text information transmission button 816 is pressed, the remote control input device 111 transmits text data to the detection controller 1.

The detection controller 1 displays the received text data on the detection information display 7.

The information transmission from the remote control input device 111 to the detection controller 1 is performed by means according to Embodiment 1 or Embodiment 2.

Thus, the operator A near the detection controller 1 can discern the situation of the detection target area and efficiently perform threshold adjustment, thus allowing more inexpensive and higher confidential information transmission than existing communication means.

Embodiment 9

Embodiment 9 will now be described with reference to FIGS. 38 and 39.

Figure 38:
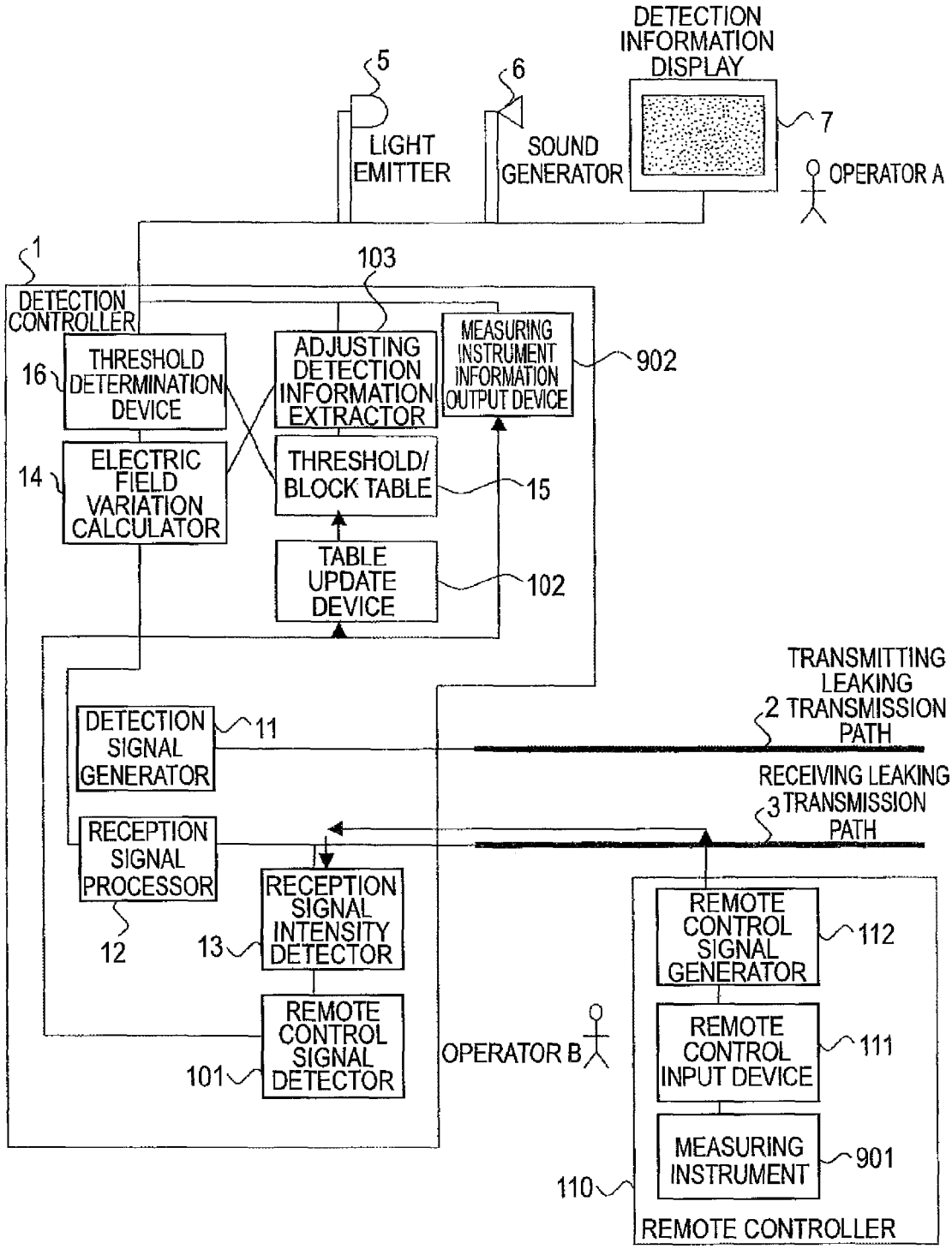
FIG. 38 is a diagram showing yet another example of a system configuration of an intrusion detection system according to Embodiment 9 of the present invention.
Figure 39:
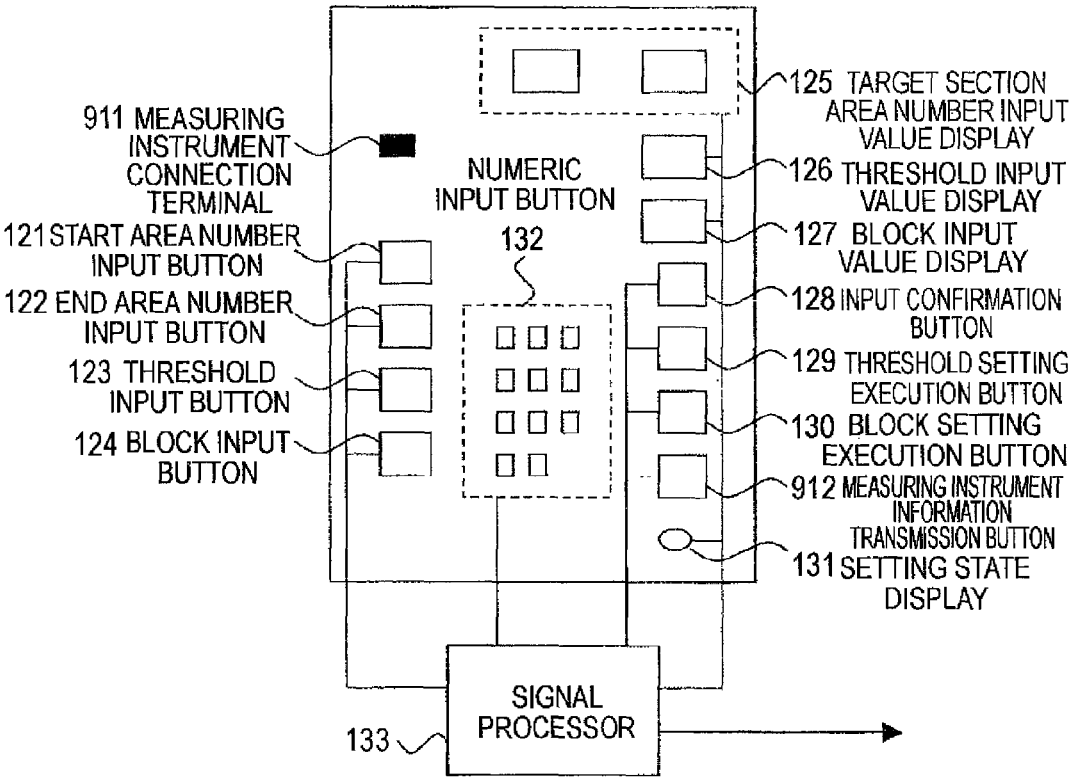
FIG. 39 is a diagram showing an example of a detailed configuration of a remote control input device in the intrusion detection system of FIG. 38 according to Embodiment 9 of the present invention.

FIG. 38 shows an example of a system configuration of an intrusion detection system according to Embodiment 9, and FIG. 39 shows an example of a detailed configuration of a remote control input device in the intrusion detection system of FIG. 36.

According to Embodiment 9, in the configuration of Embodiment 1, a function for connecting a measuring instrument 901 is added to the remote control input device 111, the measuring instrument 901 connected to the remote control input device 111 such as a spectrum analyzer is disposed near the transmitting leaking transmission path 2 or the receiving leaking transmission path 3, and the information transmission means according to Embodiment 1 or Embodiment 2 transmits measurement information from the spectrum analyzer.

The measuring instrument 901 such as a spectrum analyzer is connected by a measuring instrument connection terminal 911. The connection to the measuring instrument 901 is achieved by, for example, GPIB and USB.

Next, the procedure of the transmission of measuring instrument information will be described.

The operator presses a measuring instrument information transmission button 912 of the remote control input device 111. When the measuring instrument information transmission button 912 is pressed, the remote control input device 111 communicates with the connected measuring instrument 901 to obtain measurement information. The obtained measurement information is transmitted to the detection controller 1.

The transmitted measurement information is displayed on the detection information display 7.

The measurement information can be used for the transmission level adjustment of a detection signal and the threshold adjustment. In addition, the measurement information may be taken in the detection controller 1 to automatically perform the setting.

Thus, the operator near the detection controller 1 can discern the situation of the electric wave propagation in the detection target area and efficiently perform threshold adjustment, thus allowing more inexpensive and higher confidential information transmission than existing communication means.

Embodiment 10

Embodiment 10 will now be described with reference to FIGS. 40 and 41.

Figure 40:
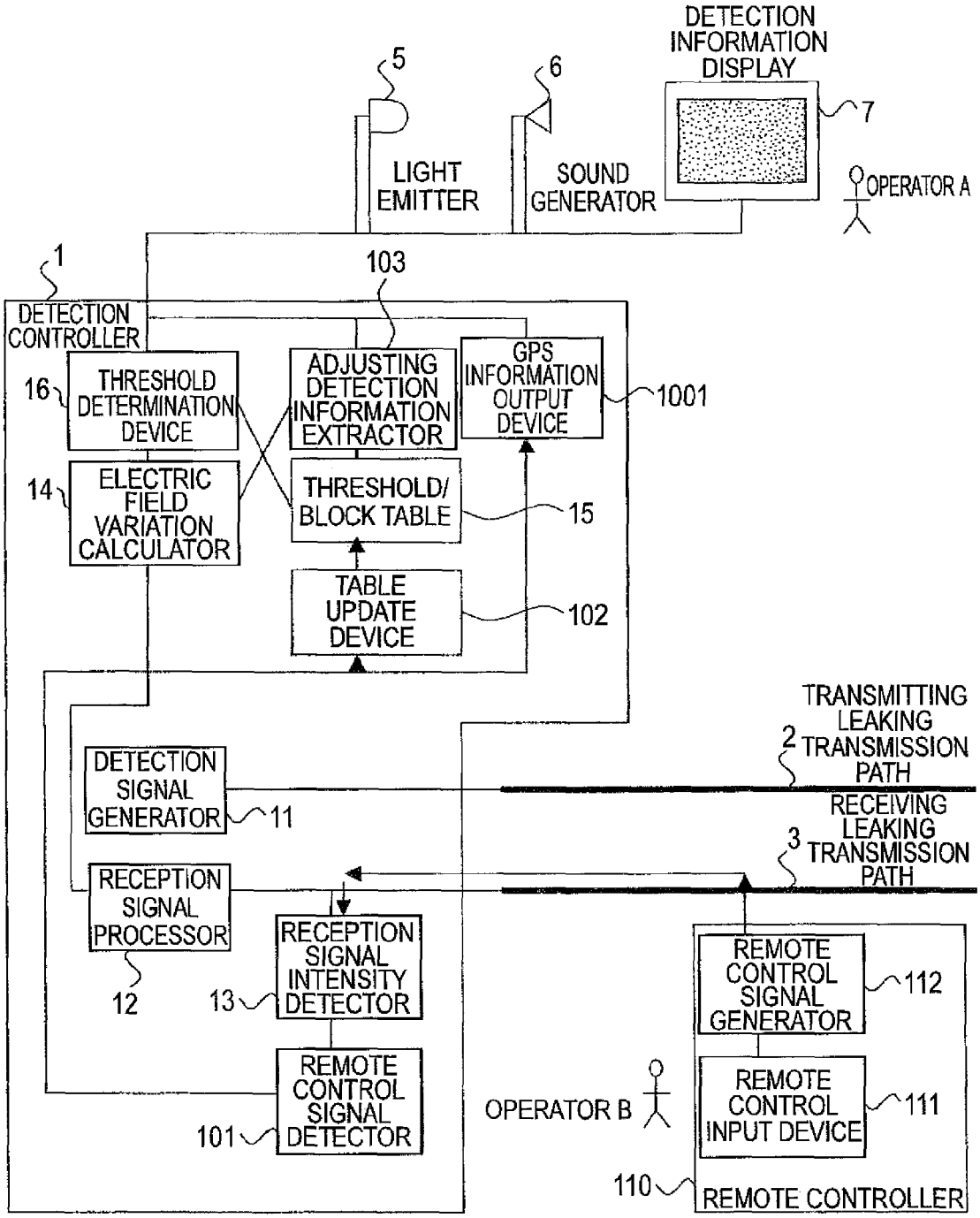
FIG. 40 is a diagram showing yet another example of a system configuration of an intrusion detection system according to Embodiment 10 of the present invention.
Figure 41:
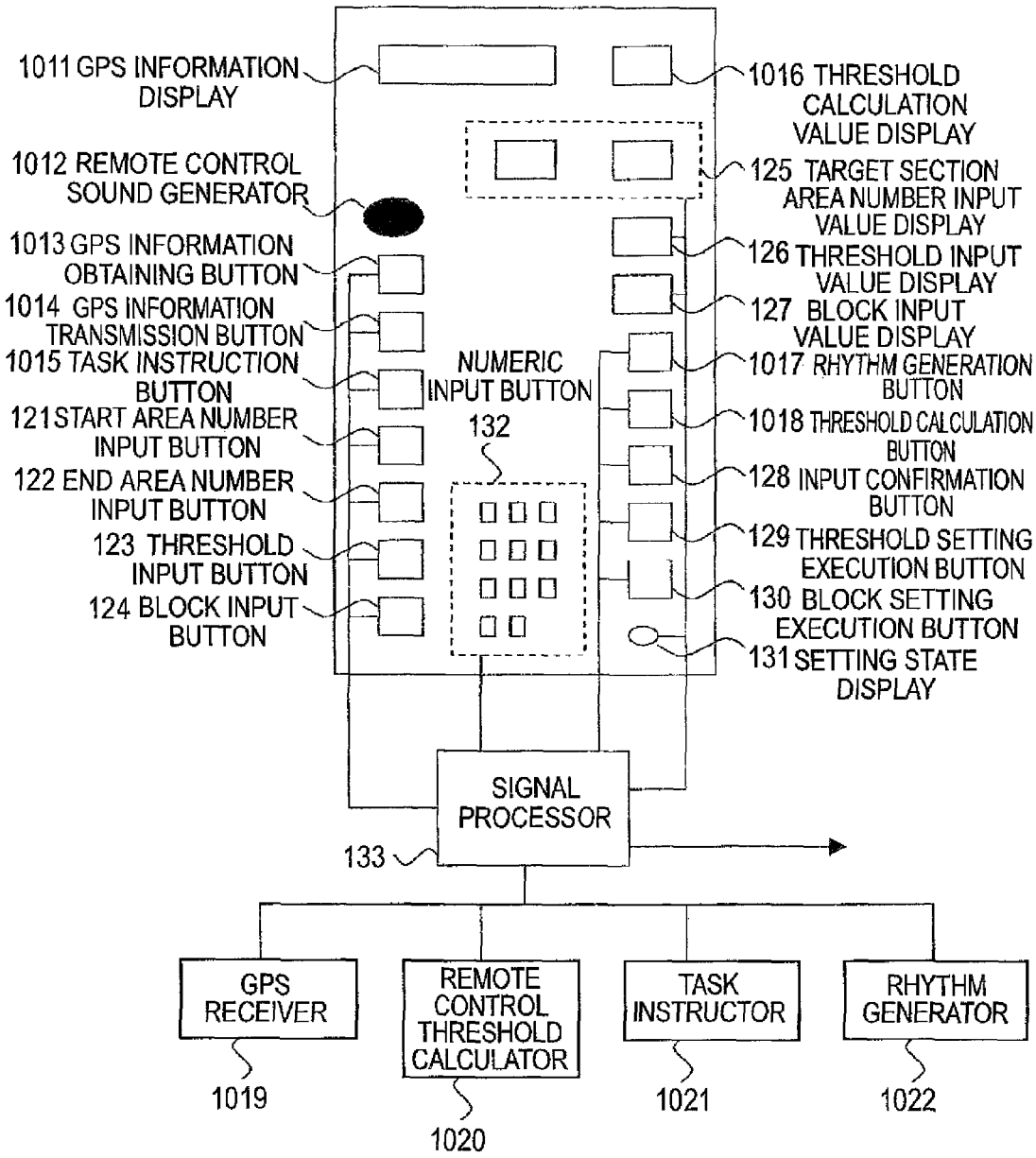
FIG. 41 is a diagram showing an example of a detailed configuration of a remote control input device in the intrusion detection system of FIG. 40 according to Embodiment 10 of the present invention.

FIG. 40 shows an example of a system configuration of an intrusion detection system according to Embodiment 10, and FIG. 41 shows an example of a detailed configuration of a remote control input device in the intrusion detection system of FIG. 36.

According to Embodiment 10, a GPS (Global Positioning System) reception function, a task instruction function, a rhythm generation function and a threshold calculation function are added to the remote controller 110 in Embodiment 1.

Next, the GPS reception function will be described.

When a GPS information obtaining button 1013 of the remote control input device 111 is pressed, a GPS receiver 1019 receives a signal from a GPS satellite, the positional information for the point where the setting operator exists is calculated, and the calculated positional information is displayed on a GPS information display 1011.

When a GPS information transmission button 1014 is pressed, the GPS information is transmitted to the detection controller 1.

By obtaining the positional information from the GPS, the setting position of the block can be discerned properly.

Next, the task instruction function will be described.

When a task instruction button 1015 is pressed, instructions are given by a task instructor 1021 for a task that an operator should perform, via a sound generated from a remote control sound generator 1012. By merely following the instruction, the operator can perform threshold adjustment.

Next, the rhythm generation function will be described.

When a rhythm generation button 1017 is pressed, a rhythm generator 1022 generates a given rhythm through the remote control sound generator 1012.

By performing intrusive movements according to the rhythm, the operator can carry out intrusive movements at a constant speed, allowing the fluctuations of the amount of variation in the electric field due to motion speed to be reduced, and allowing the fluctuations of the thresholds to be reduced.

Next, a threshold calculation function will be described.

When a threshold calculation button 1018 is pressed, and the amount of variation in an electric field is entered using the numeric input button 132, a remote control threshold calculator 1020 calculates a threshold that is to be set based on the amount of variation in the electric field.

Thus, the burden on the operator can be reduced.

Note that like reference numerals refer to like parts throughout the figures.

Various modifications and alterations of this invention will be apparent to those skilled in the art without departing from the scope and spirit of this invention, and it should be understood that this is not limited to the illustrative embodiments set forth herein.

What is claimed is:

1. An intrusion detection system in which a detection signal leaked from a transmitting leaking transmission path is received at a receiving leaking transmission path, and, based on a change in signal level of the received detection signal caused by the intrusion of an intruding object between the two transmission path, the intruding object is detected, in which, it is determined that the intruding object has intruded when, based on a table that stores a threshold for an amount of variation in a received electric wave for each of a plurality of detection target blocks established along the transmitting leaking transmission path and the receiving leaking transmission path, the amount of variation in the received electric wave exceeds the threshold, wherein by way of a reporting unit that issues a report to indicate the amount of variation in the received electric wave when intrusion occurred between the two transmission paths, and a remote controller that generates a signal which changes a threshold in the table through the receiving leaking transmission path, the threshold is adjusted properly for each of the blocks with the remote controller based on the report issued from the reporting unit to indicate the amount of variation in the received electric wave caused by a trial intrusion between the two transmission paths by a threshold setting operator.

2. An intrusion detection apparatus comprising:

a detection controller including a detection signal generator that generates a detection signal which is subjected to SS (spread spectrum) spreading to detect an intrusion into a monitoring area; a reception signal processor that extracts from a received detection signal only a signal having a specific path length by SS (spread spectrum) de-spreading; an electric field variation calculator that calculates an amount of variation in the signal that is received over the specific path length; a threshold/block table that stores a predetermined threshold and a corresponding pair of an area number and a block number; and a threshold determination device that compares the amount of variation in the received electric field with the threshold stored in the threshold/block table, and detects that an intruder exists within an area when the amount of variation in an electric field exceeds the threshold; a transmitting leaking transmission path that is connected to the detection controller and emits a detection signal as an electric wave; a receiving leaking transmission path that is connected to the detection controller, laid apart from the transmitting leaking transmission path, and receives the electric wave emitted from the transmitting leaking transmission path; a light emitter and a sound generator that are connected to the detection controller and inform an observer and the intruder via a light and a sound that an intrusion occurred; and a detection information display that is connected to the detection controller and displays the area number and the block number where the intrusion occurred on the screen, wherein the detection controller includes an adjusting detection information extractor that watches a change in the amount of variation in an electric field at the time of the intrusion and calculates the area number where the amount of variation in an electric field increases and the block number therefore, and a maximum value of the amount of variation in an electric field; a remote controller includes a remote control input device through which, based on information extracted by the adjusting detection information extractor, and informed to a setting operator who exists near the receiving leaking transmission path via a sound issued by the sound generator, the setting operator inputs information required for threshold adjustment and block adjustment, and a remote control signal generator that generates a signal in which signal intensity is changed with a specific pattern to transmit the information entered by the remote control input device as digital data; and the detection controller includes a reception signal intensity detector that detects the change in the reception signal intensity caused by reception at the receiving leaking transmission path of the signal generated by the remote control signal generator, a remote control signal detector that compares the change in the reception signal intensity detected by the reception signal intensity detector with the specific pattern transmitted by the remote control signal, detects transmitted digital data, and detects information required for threshold adjustment and block adjustment, and a table update device that stores a new threshold and a corresponding pair of the area number and the block number from the information detected by the remote control signal detector.

3. The intrusion detection apparatus according to claim 2, wherein the remote control signal generator generates a signal that is to be transmitted by the ASK (Amplitude Shift Keying), PSK (Phase Shift Keying), or QAM (Quadrature Amplitude Modulation) method in a signal orthogonal to the detection signal, to transmit information entered by the remote control input device as digital data, the signal generated by the remote control signal generator is received by the receiving leaking transmission path, and the detection controller includes a remote control signal receiver that detects information transmitted from the received signal.

4. The intrusion detection apparatus according to claim 3, comprising:

a remote control auxiliary unit that is externally mountable onto the detection controller and includes the reception signal intensity detector, the remote control signal detector, a remote control signal receiver, and a detection information transmission signal transmitter.

5. The intrusion detection apparatus according to claim 3, comprising:

a detection information transmission sound signal generator that generates an audible region or ultrasound sound signal, or a sound signal audible to humans in which a phase, amplitude or frequency is changed with a specific pattern for transmitting as a digital data the information extracted by the adjusting detection information extractor; a detection information transmission sound signal receiver that causes the sound generator to generate the sound signal generated by the detection information transmission sound signal generator, receives the sound generated by the sound generator and detects the transmitted information or recognizes the sound and extracts the information; and a remote control detection information display that displays the received information.

6. The intrusion detection apparatus according to claim 3, comprising:

a sound input device whereby the setting operator inputs sound information that is to be transmitted to another operator near the detection controller, and a text information input device whereby the operator inputs text information that is to be transmitted to the other operator near the detection controller, wherein the remote control input device has a mechanism for connecting the sound input device and the text input device, and the remote control signal generator has a function for transmitting, by means according to claim 1, the information entered by the sound input device and the text input device to the detection controller, the intrusion detection apparatus comprising a sound/text information output device that outputs the entered sound information and text information to the sound generator and the detection information display.

7. The intrusion detection apparatus according to claim 2, comprising:

a detection control side mobile phone that transmits information extracted by the adjusting detection information extractor through a mobile phone line, a remote control side mobile phone that receives information transmitted by the detection control side mobile phone through the mobile phone line, and a remote control detection information display that displays the received information, wherein the remote control side mobile phone transmits the information entered by the remote control input device and the detection control side mobile phone receives the information from the remote control side mobile phone.

8. The intrusion detection apparatus according to claim 2, comprising:

a detection information transmission signal transmitter whereby a signal for transmitting by the ASK (Amplitude Shift Keying), PSK (Phase Shift Keying), or QAM (Quadrature Amplitude Modulation) method the information extracted by the adjusting detection information extractor is superposed onto the detection signal and transmitted through the transmitting leaking transmission path, a detection information transmission signal receiver that receives the transmitted detection information transmission signal, and a remote control detection information display that displays the received information.

9. The intrusion detection apparatus according to claim 8, comprising:

a remote control auxiliary unit that is externally mountable onto the detection controller and includes the reception signal intensity detector, the remote control signal detector, a remote control signal receiver, and a detection information transmission signal transmitter.

10. The intrusion detection apparatus according to claim 9, wherein the remote control input device has a function for inputting the start of a threshold automatic adjustment mode, the remote control signal generator has a function for transmitting the information of the threshold adjustment start to a threshold adjustment mode switch associated with the detection controller, the intrusion detection apparatus comprising a threshold adjustment mode switch that shifts to a threshold adjustment mode when the information of threshold adjustment start is received, and a threshold calculator that automatically calculates a threshold that is to be set, from the amount of variation when the setting operator intrudes after shifting to the threshold adjustment mode.

11. The intrusion detection apparatus according to claim 9, comprising:

a sound input device whereby the setting operator inputs sound information that is to be transmitted to another operator near the detection controller, and a text information input device whereby the operator inputs text information that is to be transmitted to the other operator near the detection controller, wherein the remote control input device has a mechanism for connecting the sound input device and the text input device, and the remote control signal generator has a function for transmitting, by means according to claim 1, the information entered by the sound input device and the text input device to the detection controller, the intrusion detection apparatus comprising a sound/text information output device that outputs the entered sound information and text information to the sound generator and the detection information display.

12. The intrusion detection apparatus according to claim 9, wherein the remote control input device has a mechanism for connecting with a measuring instrument, the remote control input device has a function for extracting measurement information from the measuring instrument, and the remote control signal generator has a function for transmitting the measuring information from the measuring instrument to the detection controller, the intrusion detection apparatus comprising a measuring instrument information output device that outputs measurement instrument information to the sound generator and the detection information display.

13. An intrusion detection apparatus comprising, in the remote control input device according to claim 12, a GPS receiver that receives a GPS signal, a GPS information display that displays the received GPS information, a task instruction device that generates a sound signal for instructing a task that is to be performed by the setting operator, a remote control sound generator that outputs as sound and transmits to the operator the sound signal generated by the task instruction device, a rhythm generator that generates a sound signal for causing the remote control sound generator to issue a constant rhythm signal so that the operator can operate at a fixed speed, a remote control threshold calculator that inputs the amount of variation in an electric field at the time of the intrusion and calculates the threshold that is to be set, a threshold calculation value display that displays the threshold calculated by the remote control threshold calculator, the remote control signal generator having a function for transmitting the GPS information obtained by the GPS receiver to the detection controller, and a GPS information output device that outputs the GPS information to the sound generator and the detection information display.

14. The intrusion detection apparatus according to claim 2, comprising:

a remote control auxiliary unit that is externally mountable onto the detection controller and includes the reception signal intensity detector, the remote control signal detector, a remote control signal receiver, and a detection information transmission signal transmitter.

15. The intrusion detection apparatus according to claim 2, comprising:

a detection information transmission sound signal generator that generates an audible region or ultrasound sound signal, or a sound signal audible to humans in which a phase, amplitude or frequency is changed with a specific pattern for transmitting as a digital data the information extracted by the adjusting detection information extractor; a detection information transmission sound signal receiver that causes the sound generator to generate the sound signal generated by the detection information transmission sound signal generator, receives the sound generated by the sound generator and detects the transmitted information or recognizes the sound and extracts the information; and a remote control detection information display that displays the received information.

16. The intrusion detection apparatus according to claim 2, wherein the remote control input device has a function for inputting the start of a threshold automatic adjustment mode, the remote control signal generator has a function for transmitting the information of the threshold adjustment start to a threshold adjustment mode switch associated with the detection controller, the intrusion detection apparatus comprising a threshold adjustment mode switch that shifts to a threshold adjustment mode when the information of threshold adjustment start is received, and a threshold calculator that automatically calculates a threshold that is to be set, from the amount of variation when the setting operator intrudes after shifting to the threshold adjustment mode.

17. The intrusion detection apparatus according to claim 2, comprising:

a sound input device whereby the setting operator inputs sound information that is to be transmitted to another operator near the detection controller, and a text information input device whereby the operator inputs text information that is to be transmitted to the other operator near the detection controller, wherein the remote control input device has a mechanism for connecting the sound input device and the text input device, and the remote control signal generator has a function for transmitting, by means according to claim 1, the information entered by the sound input device and the text input device to the detection controller, the intrusion detection apparatus comprising a sound/text information output device that outputs the entered sound information and text information to the sound generator and the detection information display.

18. The intrusion detection apparatus according to claim 2, wherein the remote control input device has a mechanism for connecting with a measuring instrument, the remote control input device has a function for extracting measurement information from the measuring instrument, and the remote control signal generator has a function for transmitting the measuring information from the measuring instrument to the detection controller, the intrusion detection apparatus comprising a measuring instrument information output device that outputs measurement instrument information to the sound generator and the detection information display.

19. An intrusion detection apparatus comprising, in the remote control input device according to claim 2, a GPS receiver that receives a GPS signal, a GPS information display that displays the received GPS information, a task instruction device that generates a sound signal for instructing a task that is to be performed by the setting operator, a remote control sound generator that outputs as sound and transmits to the operator the sound signal generated by the task instruction device, a rhythm generator that generates a sound signal for causing the remote control sound generator to issue a constant rhythm signal so that the operator can operate at a fixed speed, a remote control threshold calculator that inputs the amount of variation in an electric field at the time of the intrusion and calculates the threshold that is to be set, a threshold calculation value display that displays the threshold calculated by the remote control threshold calculator, the remote control signal generator having a function for transmitting the GPS information obtained by the GPS receiver to the detection controller, and a GPS information output device that outputs the GPS information to the sound generator and the detection information display.

* * * * *